US010016002B2

(12) United States Patent
Murphy et al.

(10) Patent No.: US 10,016,002 B2
(45) Date of Patent: Jul. 10, 2018

(54) GARMENTS HAVING EVACUATION HARNESSES AND METHODS OF USING THE SAME

(71) Applicants: Robert K. Murphy, Lafayette, IN (US); Tom J. Africa, Lebanon, OH (US); Patrick R. Walker, Pataskala, OH (US)

(72) Inventors: Robert K. Murphy, Lafayette, IN (US); Tom J. Africa, Lebanon, OH (US); Patrick R. Walker, Pataskala, OH (US)

(73) Assignee: HYPRUM LLC, Pataskala, OH (US)

( * ) Notice: Subject to any disclaimer, the term of this patent is extended or adjusted under 35 U.S.C. 154(b) by 349 days.

(21) Appl. No.: 14/832,466

(22) Filed: Aug. 21, 2015

(65) Prior Publication Data

US 2015/0359272 A1 Dec. 17, 2015

Related U.S. Application Data

(63) Continuation-in-part of application No. 13/776,876, filed on Feb. 26, 2013, now Pat. No. 9,498,008.

(60) Provisional application No. 62/046,549, filed on Sep. 5, 2014.

(51) Int. Cl.
*A41D 13/00* (2006.01)
*A62B 35/00* (2006.01)

(52) U.S. Cl.
CPC ..... *A41D 13/0007* (2013.01); *A62B 35/0025* (2013.01)

(58) Field of Classification Search
CPC ..... A41D 31/0007; A62B 35/001; A62B 35/0031; A62B 35/0037
See application file for complete search history.

(56) References Cited

U.S. PATENT DOCUMENTS

| | | | |
|---|---|---|---|
| 2,699,284 | A | 6/1952 | Rose |
| 2,979,153 | A | 4/1961 | Hoagland et al. |
| 2,996,228 | A | 8/1961 | Bauman |
| 3,074,074 | A | 1/1963 | Lovering |
| 3,973,643 | A | 8/1976 | Hutchinson |
| 4,211,218 | A | 7/1980 | Kendrick |
| D270,585 | S | 9/1983 | Viio |
| 4,422,454 | A | 12/1983 | English |
| 4,449,253 | A | 5/1984 | Hettinger |
| 4,478,311 | A | 10/1984 | Anderson |
| 4,593,788 | A | 6/1986 | Miller |

(Continued)

OTHER PUBLICATIONS http://www.rescue-essentials.com/Combat_Rescue_Sling_C_R_S_p/50-0461.htm; (date available to public at least as early as Jan. 16, 2013).

(Continued)

*Primary Examiner* — Danny Worrell
(74) *Attorney, Agent, or Firm* — Cook Alex Ltd.

(57) ABSTRACT

Garments having an evacuation harness that are intended for connection to each other, with each garment having an outer wear unit including at least a torso portion and an evacuation harness that includes a torso strap system connected to the outer wear unit. The garments may include an outer wear pant having a leg strap system. Garments that are similar to each other conveniently may be used in a rescue garment system. Also disclosed are methods of connecting an individual to be rescued to one or more rescuers wearing similar garments.

26 Claims, 23 Drawing Sheets

(56) References Cited

U.S. PATENT DOCUMENTS

| | | | | |
|---|---|---|---|---|
| 4,682,671 | A | 7/1987 | Hengstenberger et al. | |
| 4,706,858 | A | 11/1987 | Whatley | |
| 4,854,418 | A | 8/1989 | Hengstenberger et al. | |
| 4,863,409 | A | 9/1989 | Johnson et al. | |
| 5,027,833 | A | 7/1991 | Calkin | |
| 5,080,191 | A | 1/1992 | Sanchez | |
| 5,435,272 | A | 7/1995 | Epstein | |
| 5,617,582 | A | 4/1997 | Burwell | |
| 5,799,328 | A | 9/1998 | Harlem et al. | |
| 5,960,480 | A | 10/1999 | Neustater et al. | |
| 5,970,517 | A | 10/1999 | Jordan | |
| 6,101,631 | A | 8/2000 | Ferguson, Jr. | |
| 6,105,169 | A | 8/2000 | Colorado | |
| 6,122,778 | A | 9/2000 | Cohen | |
| 6,205,584 | B1 | 3/2001 | Yocco | |
| 6,256,789 | B1 | 7/2001 | Young et al. | |
| 6,427,252 | B1 | 8/2002 | Lewis et al. | |
| 6,637,547 | B1 | 10/2003 | Wydner | |
| 6,651,594 | B1 | 11/2003 | Bagwell | |
| 6,658,666 | B2 | 12/2003 | Schweer | |
| 6,662,372 | B2 | 12/2003 | Lewis et al. | |
| 6,800,007 | B2 | 10/2004 | Calkin | |
| 6,892,395 | B2 | 5/2005 | Schweer | |
| 7,036,628 | B2 | 5/2006 | Wilcox et al. | |
| 7,047,567 | B2 * | 5/2006 | Allen | A41D 13/0007 2/69 |
| 7,086,091 | B2 | 8/2006 | Jordan | |
| 7,356,850 | B2 | 4/2008 | Turcotte et al. | |
| 7,451,495 | B2 | 11/2008 | Munn et al. | |
| 7,467,419 | B2 | 12/2008 | O'Neal et al. | |
| 7,774,878 | B1 | 8/2010 | Florea et al. | |
| 7,814,567 | B2 | 10/2010 | Dovner et al. | |
| 7,917,968 | B2 | 4/2011 | Roux | |
| 7,971,273 | B2 | 7/2011 | Grilliot et al. | |
| 7,987,520 | B2 | 8/2011 | Henriquez | |
| 8,015,619 | B2 | 9/2011 | McKay et al. | |
| 8,016,335 | B2 | 9/2011 | McKay | |
| 8,162,365 | B2 | 4/2012 | Escobar | |
| 8,256,020 | B2 | 9/2012 | Dovner et al. | |
| 8,375,467 | B2 | 2/2013 | Real et al. | |
| 8,430,204 | B1 | 4/2013 | Reynolds | |
| 8,438,664 | B2 | 5/2013 | Fee et al. | |
| 8,990,971 | B2 | 3/2015 | Carter | |
| 2007/0044197 | A1 | 3/2007 | Turcotte et al. | |
| 2007/0199135 | A1 | 8/2007 | Grillict et al. | |
| 2009/0095232 | A1 | 4/2009 | McKay | |
| 2009/0127300 | A1 | 5/2009 | Straight | |
| 2011/0030118 | A1 * | 2/2011 | Pratchett | A41D 13/0007 2/81 |
| 2011/0284322 | A1 | 11/2011 | West | |
| 2011/0302685 | A1 | 12/2011 | Fay, III | |
| 2011/0302688 | A1 | 12/2011 | Vieux | |
| 2012/0023638 | A1 | 2/2012 | Leicester | |
| 2014/0237698 | A1 | 8/2014 | Murphy | |
| 2014/0325733 | A1 | 11/2014 | Rae et al. | |
| 2015/0033458 | A1 | 2/2015 | Theisen et al. | |
| 2015/0359272 | A1 | 12/2015 | Murphy et al. | |

OTHER PUBLICATIONS http://www.rescue-essentials.com/Slishman_Rescue_Pack_w_Harness_p/slishman.htm; (date available to public at least as early as Jan. 16, 2013).

http://www.rescue-essentials.com/NAR_Dragon_Harness_p/50/0464.htm.; (date available to public at least as early as Jan. 16, 2013).

* cited by examiner

GARMENTS HAVING EVACUATION HARNESSES AND METHODS OF USING THE SAME

CROSS-REFERENCE TO RELATED APPLICATION

This application is a continuation-in-part of co-pending U.S. patent application Ser. No. 13/776,876, filed Feb. 26, 2013, and claims the benefit of U.S. Provisional Patent Application Ser. No. 62/046,549, filed Sep. 5, 2014, and further incorporates by reference the disclosures of both prior applications in their entireties.

FIELD OF THE DISCLOSURE

The present disclosure is directed to garments used for protection in inherently dangerous environments, such as body armor vests, protective coats and pants, and more particularly to such garments that include an evacuation harness and to methods of using the same.

BACKGROUND

Many individuals are faced with inherently dangerous situations and circumstances as part of their service in a military, law enforcement or firefighting position, or the like. Such individuals not only are susceptible to encountering situations where they may be seriously injured, incapacitated or rendered unconscious, but also are susceptible to being the one person present when a fellow professional falls victim to such misfortune and is in need of immediate evacuation from such a setting.

There are prior art devices that have been used to evacuate or extract an injured, incapacitated or unconscious individual from a dangerous situation. Such devices typically include a separate tow or drag line, or a strap, that is carried by a rescuer and can be connected at a first end to the individual to be extracted or to a sheet, sled or other object on which the individual may be lying, and then grasped by or connected to a rescuer at a second end.

Unfortunately, in many situations, there is no sled or other device available, and there is insufficient time or freedom to manipulate a harness that would have to be separately carried and then donned by the injured individual and/or one or more rescuers. Existing devices are not configured for both an injured individual and a rescuer to be wearing the same garments and to have the garments work in cooperation with each other to assist in an extraction. Moreover, it is common for devices to include a single means by which to connect to or grasp the individual, which may not be convenient to a rescuer or provide an advantageous position for one or more rescuers to pull, tow or carry the individual to safety. When including a tow or drag line, the devices also typically include a single narrow line or strap that will not prevent the individual being dragged from twisting or rotating to a position on a side or face down, which may inflict additional injuries. The devices also commonly lack structure to support the individual in such a manner that, if the individual is conscious and coherent, the individual may observe and communicate with the rescuer with respect to the setting behind them. At present, there remains a need for improvements in devices for use by rescuers to evacuate or extract an individual from a dangerous situation.

SUMMARY

The present disclosure includes example devices that are garments, with each garment having an evacuation harness that is connected to the garment. The garment and harness are constructed for universal use, in the sense that the same device is to be worn by all personnel, and will be appropriate to permit extraction of the individual, as well as be appropriate to allow one or more rescuers to achieve the extraction of the individual. In this way, two or more like garments form a rescue garment system. The garments have an evacuation harness and may include multiple structures that permit rescuers to utilize a plurality of configurations to tow, drag or carry the individual, depending on the immediacy required, the availability of time and space to deploy certain advantageous structures of the device, the number and strength of the rescuers, and the position the one or more rescuers may be able to assume while evacuating the individual.

In a first aspect, the present disclosure relates to a garment having an evacuation harness that includes an outer wear unit having at least a torso portion, and an evacuation harness that includes a torso strap system connected to the outer wear unit. The torso strap system includes at least two upper connectors and at least one retaining strap, wherein when the garment is worn by a user the upper connectors are proximate an upper rear portion of the outer wear unit and the at least one retaining strap extends downward from the torso strap system along a portion of a leg of the user and includes a strap portion that encircles a leg of the user. The evacuation harness further includes a drag strap coupling connected to the torso strap system and extending rearward relative to the outer wear unit, and a drag strap connected at a first end to the torso strap system at a position above the drag strap coupling and the drag strap being selectively extendible rearward relative to the outer wear unit.

In another aspect, the present disclosure relates to a rescue garment system including a first garment further having an upper body outer wear unit including at least a torso portion and an evacuation harness, wherein the evacuation harness further includes a torso strap system connected to the outer wear unit, a drag strap coupling connected to the torso strap system and extending rearward relative to the outer wear unit, a drag strap connected to the torso strap system at a position above the drag strap coupling and being selectively extendible rearward from the outer wear unit. The rescue garment system further including a second garment further having an outer wear pant including a leg strap system having at least one leg strap extending down at least a portion of a rear thigh region of the outer wear pant, wherein the at least one leg strap is connected to the outer wear pant and further includes at least one connector.

In a further aspect, the present disclosure relates to a rescue garment system having at least two similar garments, each of the garments further having an outer wear unit including at least a torso portion, and an evacuation harness that includes a torso strap system connected to the outer wear unit, a drag strap coupling connected to the torso strap system and extending rearward relative to the outer wear unit, and a drag strap connected at a first end to the torso strap system at a position above the drag strap coupling and the drag strap being selectively extendible rearward relative to the outer wear unit, and wherein the drag strap of one of the respective at least two garments is configured to be removably connected to the drag strap coupling of the other of the respective at least two garments.

In yet another aspect, the present disclosure relates to a method of connecting an individual to at least first and second rescuers with the individual and rescuers wearing similar outer wear units and similar outer wear pants, wherein each outer wear unit is part of a garment having an evacuation harness and each outer wear pant includes a leg strap system, with the evacuation harness further including a torso strap system connected to the outer wear unit, a drag strap coupling connected to the torso strap system and extending rearward relative to the outer wear unit, a drag strap connected to the torso strap system and being selectively extendible rearward relative to the outer wear unit, two or more auxiliary straps connected to the torso strap system and being selectively extendible from sides of the outer wear unit, and the leg strap system further comprising leg straps positioned proximate respective rear portions of thighs of the individual and rescuers. The method further includes the steps of extending from the garment of the individual the drag strap in a direction opposite to a direction that the individual is facing, connecting the drag strap on the garment of the individual to the drag strap coupling on the garment of the first rescuer with the first rescuer being positioned in the direction opposite to the direction the individual is facing and having the drag strap coupling on the garment of the first rescuer extending in a direction rearward relative to the first rescuer, wherein the individual faces substantially opposite to a direction of forward travel of the first rescuer, and connecting at least one leg strap on the garment of the individual to one of the auxiliary straps on the garment of the second rescuer with the second rescuer being positioned rearward of the first rescuer and proximate a leg of the individual and having the auxiliary strap on the garment of the second rescuer extending in a direction toward the leg of the individual and being connected to the leg strap on the outer pant associated with the leg of the individual, wherein the individual faces toward the second rescuer and is lifted by the first and second rescuers to a position at least partially above a ground surface.

In a further aspect, the present disclosure relates to a garment having an evacuation harness that includes an outer wear unit having at least a torso portion, and an evacuation harness that includes a torso strap system connected to the outer wear unit, with the torso strap system including at least two upper connectors, wherein when the garment is worn by a user the upper connectors are proximate an upper portion of the outer wear unit, and at least two auxiliary straps connected to the torso strap system and being laterally spaced apart, wherein the at least two auxiliary straps are stowable within and selectively extendible from the outer wear unit.

In a still further aspect, the present disclosure relates to a rescue garment system that includes at least two garments that are similar, each of the garments further having an outer wear unit including at least a torso portion, and an evacuation harness including a torso strap system connected to the outer wear unit, the torso strap system including at least two upper connectors, wherein when the garment is worn by a user the upper connectors are proximate an upper portion of the outer wear unit, and at least two auxiliary straps connected to the torso strap system and being laterally spaced apart, wherein the at least two auxiliary straps are stowable within and selectively extendible from the outer wear unit.

Garments including an evacuation harness consistent with the present disclosure provide convenient, compact, easy to use devices that can be conveniently and unobtrusively carried by all personnel, rapidly deployed without the use of tools, and provide a plurality of advantageous configurations to permit a rescuer to effectively immediately choose an appropriate configuration for the circumstances, and to thereafter utilize a more advantageous configuration, if provided an opportunity to do so. The devices provide an immediate solution for individuals and rescuers when faced with what could be a grave situation. The connection of a rescuer to the individual also advantageously may permit hands-free pulling and/or lifting by one or more rescuers, which may permit both rescuers and individuals being rescued to participate in protecting themselves or others, such as by continuing to be able to operate a weapon, a fire extinguisher or other safety equipment.

The evacuation harness of a garment includes a torso strap system that is connected to the outer wear unit or a leg strap system connected to an outer wear pant, while allowing selectively extendible portions to be conveniently and efficiently stowed and ready for immediate use. It will be appreciated that the torso strap system may be connected to the outer wear unit in various ways, which may include integrating the harness into a garment, such as by having it sewn or otherwise connected within the outer wear unit, whether by sewing it directly to an inner side of the outer wear unit or by locating it between a lining and the outer wear unit. When located within the outer wear unit, portions of the evacuation harness may be stowed within the outer wear unit and may be selectively extendible through apertures in the outer wear unit. Releasable flaps or other coverings and/or zippers or other closures may be used to help retain the portions of the harness that are stowed during normal use of the garment. The torso strap system also could be connected to the outer wear unit by being sewn or otherwise connected to an outer side of the outer wear unit. In such instances, the selectively extendible portions of the harness may include temporary holding structures, such as hook and loop fasteners, snaps or the like, to hold the extendible portions adjacent to the garment when not deployed.

It also will be appreciated that the devices may be embodied in protective garments worn by personnel serving in various different capacities. Thus, the garments may be constructed, for example, to be worn by soldiers or police personnel in the form of armored vests or pants, while those worn by firefighters may be constructed in the form of fireproof coats, pants or the like. Such garments may be stocked and provided by the military, or first responder and other emergency organizations for use in situations when weaponry has been or may be utilized, or when fire, natural disasters or other events pose a threat of injury or loss of life to personnel. Whether provided by a governmental or private entity, the ability to conveniently and seamlessly carry universal evacuation devices within garments that already will be worn by all personnel and that is configured to be complementary to and used with a similar garment may provide some valuable peace of mind to those who know their service may result in serious injury that could require rapid evacuation of personnel.

BRIEF DESCRIPTION OF THE DRAWINGS

The above-mentioned and other features of the present disclosure, and the manner of attaining them, will become more apparent and will be better understood by reference to the following description of exemplary embodiments of the present disclosure, taken in conjunction with the accompanying drawings, wherein.

Figure 1:
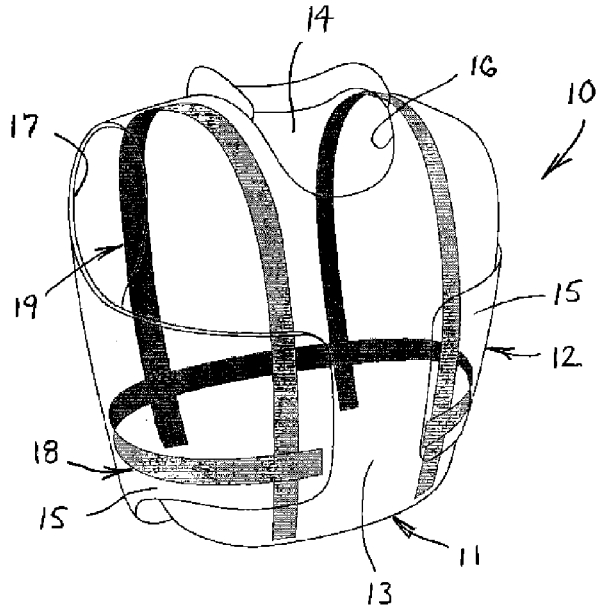
FIG. 1 is a front perspective view of a garment that includes an outer wear unit and an evacuation harness and is shown in a closed position, as it would be worn.

Corresponding or related reference numerals indicate corresponding parts throughout the several views. Although the drawings represent exemplary embodiments of the present disclosure, the drawings are not necessarily to scale and certain features may be exaggerated, removed or shown in phantom to better illustrate and explain the present disclosure.

FIGS. 1-10 show an example garment 10 having an outer wear unit 11 that includes at least a torso portion 12 that may be donned and worn about the torso of a person. While other configurations for vests, coats or other outer wear units may be used, depending on the configuration chosen, as in the present example, the outer wear unit 11 may include a front portion 13, a rear portion 14, side portions 15, a neck hole 16, and arm holes 17. It will be appreciated that the neck and arm holes may be formed into the outer wear unit, as with the neck hole 16 of this example, or formed in conjunction with overlapping panels when donning the outer wear unit, as with the arm holes 17 of this example. The different portions of the vest may be connected together or selectively connected to each other by use of conventional fastening means, such as hook and loop fasteners, releasable buckles, snaps or the like. The example garment 10 is constructed in the form of body armor or a ballistic vest, such as may be worn by military or law enforcement personnel. The construction of the outer wear unit 11 may include suitable materials to accomplish the intended purpose. For instance, among other materials, a body armor vest may include any one of several bullet resistant woven fabrics, such as Kevlar®, and may enclose or cover metal or ceramic bulletproof plates. However, it should be noted that the garments may be constructed for various other purposes, such as, for example, in the form of a fire coat, which may include fireproof materials.

The garment 10 also includes an evacuation harness 18. The evacuation harness 18 has a torso strap system 19 that is connected to the outer wear unit 11. It should be noted that the term torso strap system is being used to mean a construction that includes a group of flexible, relatively high strength elements, such as woven straps, rope or other lines that are connected together in a configuration to generally surround the torso of an individual, and may include other molded integrally formed webbing structures. Thus, in the present disclosure, the term strap should be understood to mean a flexible element, and need not be relatively wide and thin. The construction of the evacuation harness 18 may include suitable relatively light weight, strong and flexible materials, such as Kevlar®, Nylon, plastics or the like. In addition, the evacuation harness 18 may be connected to the outer wear unit 11 in a variety of ways, such as by being sewn or snapped to an inner and/or an outer side of the outer wear unit 11, or located between an inner liner 20, made of a suitable material, and the outer wear unit 11.

Connected to the torso strap system 19 of the evacuation harness 18 is a drag strap coupling 21 that extends rearward relative to the outer wear unit 11. In this example, the drag strap coupling 21 is located so as to be proximate the tailbone of the garment wearer and includes a connector in the form of a ring or plate having an aperture. The drag strap coupling 21 of this example is connected to the torso strap system 19 in a manner that permits some freedom of movement, such as to accommodate forces on the drag strap coupling 21 that may tend to cause pivoting and/or twisting. It will be appreciated that the drag strap coupling may have a different location and/or configuration, such as, for instance, being formed as a part of a flexible element of the torso strap system, or as including a plurality rings or plates, or apertures within a plate. When the drag strap coupling is of a more rigid construction, such as the plate in the present example, then the drag strap coupling may be constructed of aluminum, titanium, steel or other metal alloys, or of composite or plastic materials or the like.

On the rear portion 14 of the outer wear unit 11, preferably positioned above the drag strap coupling 21, is a drag strap 22 that has a first end 24 connected to the torso strap system 19. The drag strap 22 is selectively extendible rearward relative to the outer wear unit 11 and terminates in a second end 25 that includes a connector 26 that is intended to be connectable to a drag strap coupling 21 on a similar garment. In this example, the connector 26 is a releasable connector, such as in the form of a carabiner or clasp that is releasably connectable to a drag strap coupling on a similar garment. The connector 26 may be constructed of materials similar to those mentioned above with respect to the drag strap coupling. The drag strap 22 includes flexible, high strength elements, such as woven straps, rope or other lines, and is shown in this example as including longitudinal strap members 27 and lateral strap members 28 that are connected together to form an advantageous web or ladder-type structure that provides a head support portion 29 for the individual being evacuated. Thus, the head support portion 29 is available to help support and stabilize the head of an individual that leans back into the drag strap 22 while being rescued.

The drag strap 22 also may include further connectors 30, or selected locations along the strap structure where a connector may be looped around a strap or through an aperture in a strap, to permit additional advantageous connections to a similar garment, as will be discussed herein. When the connectors 30 are of a more rigid construction, they may be made of materials similar to those mentioned above with respect to the drag strap coupling. Also, it will be appreciated that any of the structures utilized for the drag strap coupling and the connectors on the drag strap may be of a fixed configuration, such as a continuous ring or strap, or of a releasable construction, such as a carabiner or clasp, as long as such structures are used in a complementary manner to permit releasable connection between mating structures of two similar garments. Thus, at least one of a mating or complementary set of connectors should have a releasable configuration, and preferably is designed for quick and easy attachment and detachment.

The evacuation harness 18 of this example further includes at least two auxiliary straps 32 that are selectively extendible from the outer wear unit 11. The auxiliary straps 32 are laterally spaced apart and each auxiliary strap 32 of this example has a first segment 34 that is connected at a first end 36 to the torso strap system 19 and at a second end 38 that includes a connector 40. In the example shown, the connectors 40 are releasable connectors, such as a carabiner or a clasp for connection to a respective connector 30 on a drag strap 22 of a similar garment 10. If of rigid construction, such as in the example shown, the connectors 40 may be made of materials similar to those mentioned above with respect to the drag strap coupling. However, as noted above, at least one of the complementary connectors should be of a releasable configuration to permit the connecting and disconnecting of the similar garments in a quick and easy manner, and one or more of the complementary connectors could be of a flexible construction, such as being a portion of a respective strap. It will be appreciated that the auxiliary connections of respective connectors 30, 40 may provide for enhanced stability of the connection between the two garments. Such connections may help keep an individual being evacuated in an upright orientation, by resisting the potential rolling or twisting of the drag strap that would occur if such an individual were to roll or turn over relative to the ground surface while being dragged. Thus, this advantageous feature may reduce the likelihood of incurring further injuries during an evacuation.

Each auxiliary strap 32 of this example also includes a second segment 42 that is connected to the second end 38 of the first segment 34, and that is releasably connected to the first segment 34 along its length, such as by use of hook and loop fastener portions, snaps or other suitable releasable fastening structures. The second segments 42 are shown connected along their length to the first segments 34 in FIGS. 7, 8 and 10, and are shown separated along their length in FIG. 9.

Each second segment 42 of an auxiliary strap 32 further includes a grasping portion 44 at a second end. The grasping portion 44 preferably is configured for easy and secure engagement and disengagement by a hand of a rescuer wearing a garment 10, and thus may be configured with a loop, knot or other suitable integrally formed or added handle. The auxiliary straps 32 may be constructed to provide for quick and easy separation of the first and second segments 34, 42 upon simply pulling the grasping portion 44 in a direction away from the first end 36 of an auxiliary strap 32.

As will be discussed further herein, with the connectors 40 of the auxiliary straps 32 on a garment 10 worn by a rescuer being connected to the connectors 30 on the drag strap 22 of an individual being evacuated, the rescuer may pull the grasping portions 44 upward and over the top of the rescuer's shoulders to partially lift the individual being evacuated. Such a partially lifted position may advantageously permit the individual to be dragged without having the torso seated on a ground surface. This may reduce the likelihood of injuries that could occur during a rapid seated extrication over rough or uneven surfaces. The garment 10 also may include one or more connectors positioned on the front of the torso portion and to which the grasping portions 44 may be releasably connected. Such further connection of the grasping portions 44 may permit the rescuer to continue to partially suspend the individual being evacuated, while providing the highly useful benefit of returning to hands-free connection of the respective garments. The hands free evacuation afforded by use of the present garment 10 provides the strategic advantage of permitting the rescuer to handle a weapon or safety equipment, or to otherwise use the hands for enhanced balance and to generate added climbing and/or pulling power.

In the example shown in FIGS. 1-10, the garment 10 is constructed with the torso strap system 19 being located inside of the outer wear unit 11, but hidden from view by the inner liner 20. This construction permits the use of pouches within the outer wear unit 11, so that the drag strap 22 and auxiliary straps 32 are stowable within the outer wear unit 11 when not in use. Flaps or other closures also may be used on the rear portion 14 or side portions 15 of the outer wear unit 11 to releasably cover apertures through which the straps are selectively extendible. The facility to stow the straps helps prevent the straps from snagging on objects when not deployed. Releasable flaps may be held in a closed position by use of suitable fasteners, such as hook and loop material, snaps or the like.

Figure 4:
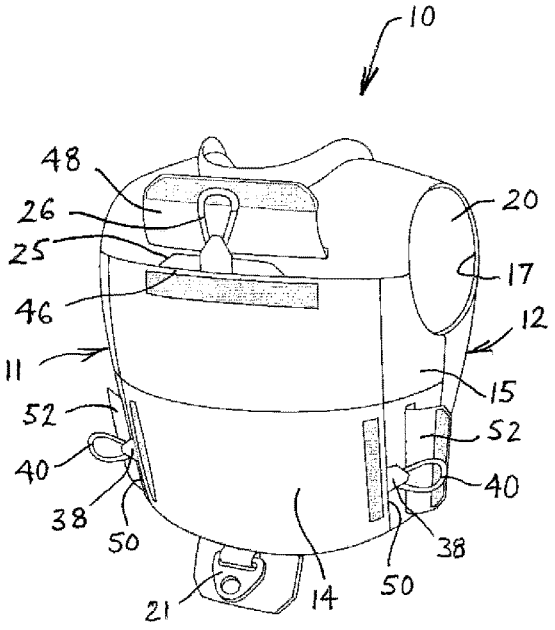
FIG. 4 is a rear perspective view of the garment of FIGS. 1-3, showing flaps in an open position and revealing an end of a drag strap and ends of auxiliary straps.
Figure 5:
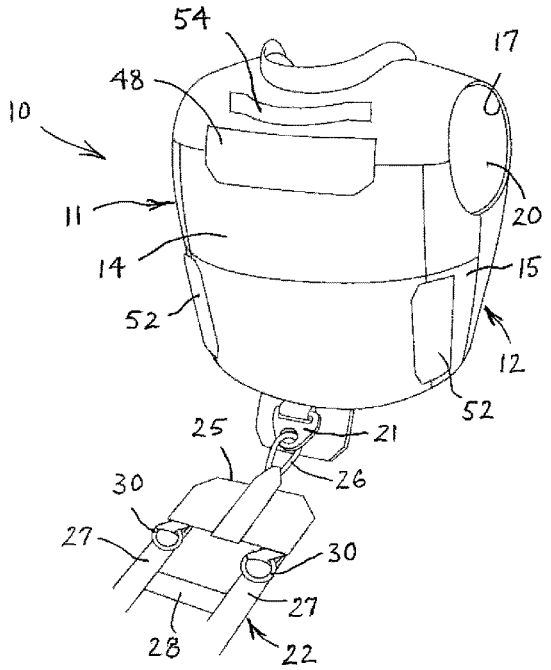
FIG. 5 is a rear perspective view of the garment of FIGS. 1-4, showing a drag strap coupling extending rearward relative to the outer wear unit and an end of a drag strap of a similar garment connected thereto.
Figure 6:
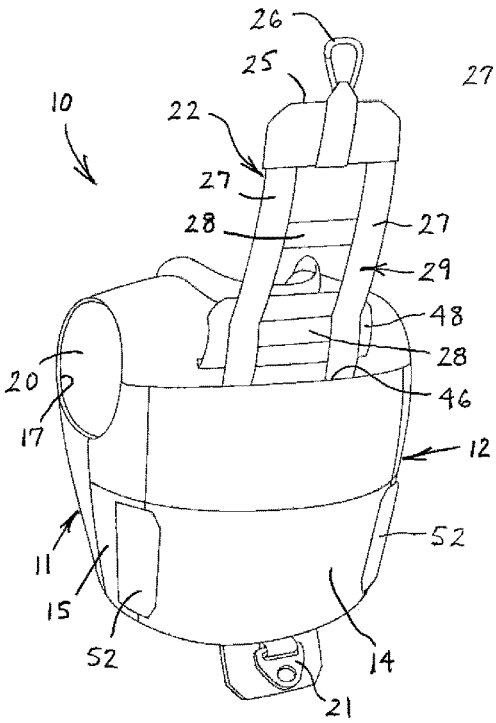
FIG. 6 is a rear perspective view of the garment of FIGS. 1-4, showing a drag strap extending rearward relative to the outer wear unit.
Figure 7:
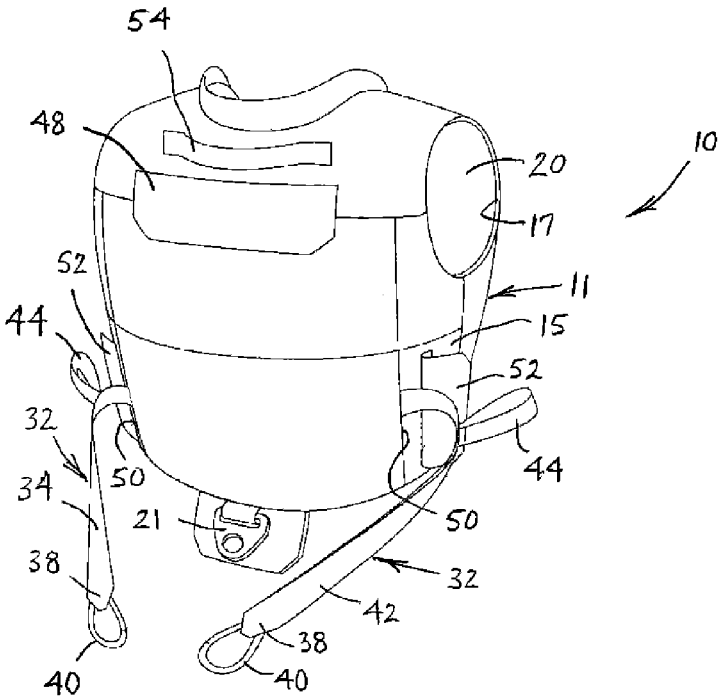
FIG. 7 is a rear perspective view of the garment of FIGS. 1-4, showing a drag strap coupling extending rearward relative to the outer wear unit, as well as auxiliary straps extending from the outer wear unit.
Figure 8:
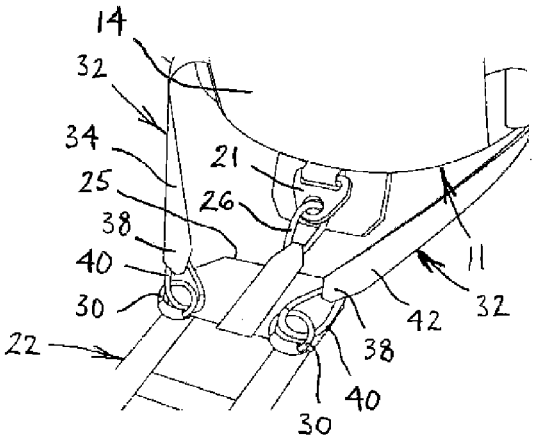
FIG. 8 is a rear perspective view of a portion of the garment of FIGS. 1-4, showing a drag strap coupling and auxiliary straps extending rearward relative to the outer wear unit and being connected to a drag strap of a similar garment.
Figure 9:
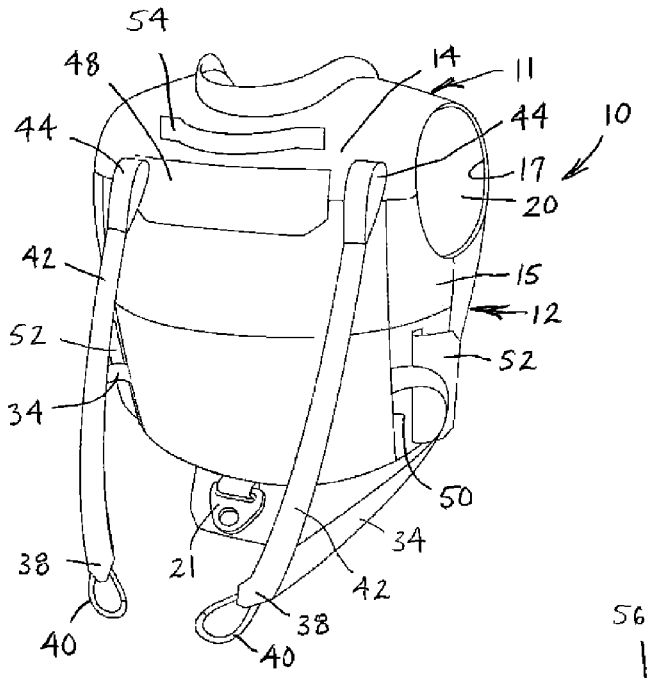
FIG. 9 is a rear perspective view of the garment of FIGS. 1-4, showing the auxiliary straps having second segments that are connected to first segments, but separated therefrom along their lengths.
Figure 10:
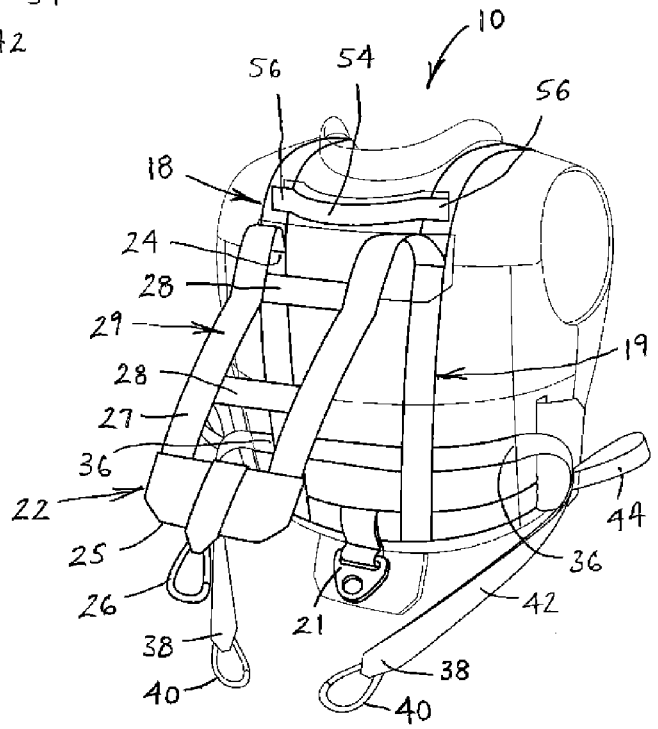
FIG. 10 is rear perspective view of the garment of FIGS. 1-4, showing the outer wear unit in lighter phantom lines and showing the evacuation harness in heavier solid lines with the drag strap coupling, drag strap, and auxiliary straps extending from the outer wear unit.

In the present example, the outer wear unit 11 includes an aperture 46 by which one can reach in and retrieve the stowed drag strap 22 to selectively extend the drag strap 22 rearward relative to the outer wear unit 12. The aperture is releasably covered by a flap 48 that is located on the rear portion 14 of the outer wear unit 11. This can be appreciated when comparing FIGS. 3, 4 and 6, which show the garment 10 with the drag strap 22 in various positions. For instance, in FIG. 3, the drag strap 22 is concealed while being stowed within the outer wear unit and the flap 48 is closed. In FIG. 4, the flap 48 is open and the second end 25 of the drag strap 22, as well as the connector 26, are extending from the aperture 46. Then, in FIG. 6, the drag strap 22 has been further extended through the aperture 46 rearward relative to the outer wear unit 12.

With respect to each of the auxiliary straps 32, the outer wear unit 11 includes an aperture 50 by which one can reach in and retrieve the stowed auxiliary strap 32 to selectively extend the auxiliary strap 32 from the outer wear unit 11. Each aperture 50 is releasably covered by a flap 52 that is located on a side portion 15 of the outer wear unit 11. This can be appreciated when comparing FIGS. 3, 4 and 7, which show the garment 10 with the auxiliary straps 32 in various positions. For instance, in FIG. 3, the auxiliary straps 32 are concealed while being stowed within the outer wear unit and each flap 52 is closed. In FIG. 4, each flap 52 is open and the second end 38 of the first segment 34 of the auxiliary straps 32 with the connectors 40 are extending from the apertures 50. Then, in FIG. 7, the auxiliary straps 32 have been further extended through the apertures 50 from the outer wear unit 12. It will be understood that the auxiliary straps could extend from the sides, rear or front of the outer wear unit, and from any position vertically between the bottom edge of the garment and the shoulders, depending on the desired configurations for connection of a first garment to a similar second garment. Also, it will be understood that for increased stability or lifting configurations, the rescue garment system of similar garments may utilize the connection of auxiliary straps extending from the rescuer's garment to the individual's garment or from the individual's garment to the garment of the rescuer.

The garment 10 of this example also includes a handle 54, which is connected to the torso strap system 19. The handle 54 is positioned above the drag strap 22, near the top of the rear portion 14 of the outer wear unit 11, and is connected to the torso strap system 19 at two spaced apart positions 56. As noted below, the handle 54 may be used when there is insufficient opportunity to connect the drag strap 22 on the garment 10 of an individual being evacuated to the drag strap coupling 21 on the garment 10 of a rescuer.

Upon reviewing FIGS. 11-14, it will be appreciated that the present garment 10 with an evacuation harness 18 provides unique advantages when a rescuer is faced with trying to evacuate an injured, incapacitated or unconscious individual wearing a similar garment 10 from a dangerous situation. The garments represent a rescue garment system that includes at least two similar garments 10, with each of the garments 10 having an outer wear unit 11 including at least a torso portion 12 and an evacuation harness 18. The evacuation harness 18 includes a torso strap system 19 connected to the outer wear unit 11, a drag strap coupling 21 connected to the torso strap system 19 and extending rearward relative to the outer wear unit 11, and a drag strap 22 connected at a first end 24 to the torso strap system 19 at a position above the drag strap coupling 21 and the drag strap 22 being selectively extendible rearward relative to the outer wear unit 11, wherein the drag strap 22 of one of the respective at least two garments 10 is configured to be removably connected to the drag strap coupling 21 of the other of the respective at least two garments 10.

FIGS. 11-14 will be described with reference to circumstances that may be faced by military or law enforcement personnel. A garment 10 is worn by each of a rescuer and an individual that needs to be extricated, with each garment 10 incorporating built-in hardware or appliances that permit the rescuer to rapidly choose and deploy the appropriate means for the given situation. Indeed, the common construction among the garments 10 worn by the two persons and the ease with which one can feel for, deploy and connect the appropriate straps and connectors likely permits a rescuer to complete an appropriate connection of the two garments without having to look at the components. This, along with the goal of getting the rescuer to hands-free operation as soon as practicable, provide unique advantages over prior art devices that must be separately carried and that require unwinding and particular positioning to don a harness and/or to apply a harness to the injured individual.

Figure 11:
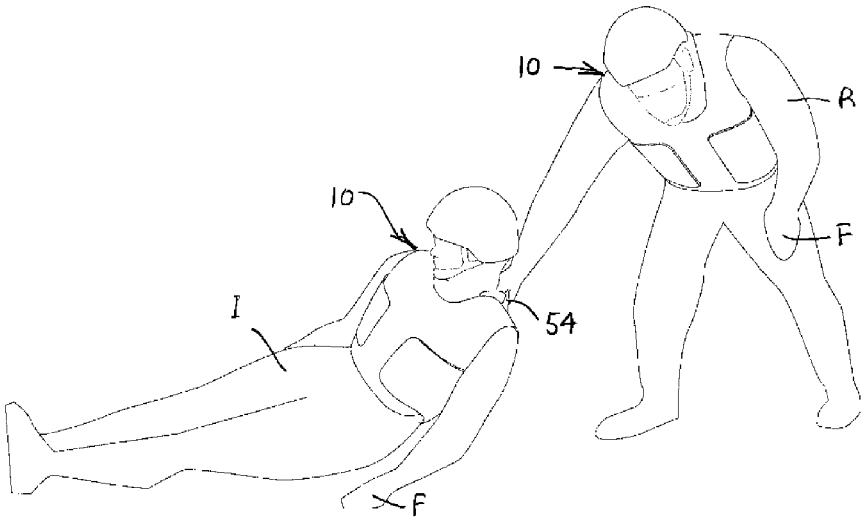
FIG. 11 is a simplified view of a rescuer wearing a garment of FIGS. 1-4 and grasping a handle on a similar garment worn by an individual seated on a ground surface.

In FIG. 11, a rescuer R is faced with the need for immediate removal of an injured individual I, such as when soldiers are under fire. In such an instance, the rescuer R may immediately grasp the handle 54 on the upper rear portion of the outer wear unit 11 of the individual I with one hand, while still being able to stay relatively low and hold a weapon or otherwise use a free hand F in attempting to drag the evacuee to less dangerous surroundings, whether in an upward or downward facing position.

Figure 12:
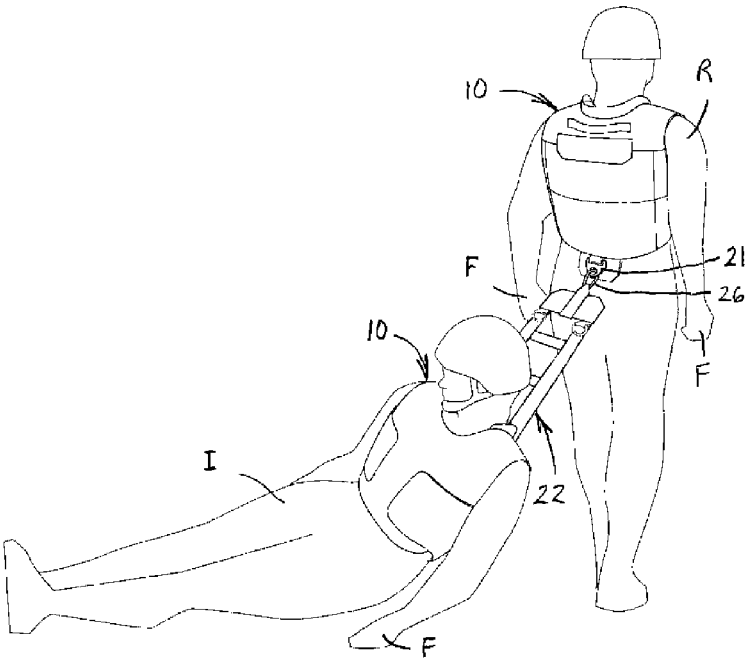
FIG. 12 is a simplified view of a rescuer wearing a garment of FIGS. 1-4 that has a drag strap coupling connected to a drag strap on a similar garment worn by an individual seated on a ground surface.

In FIG. 12, preferably once removed from open fire, but still in a highly dangerous setting, the rescuer R may extend from the garment 10 of the individual I the drag strap 22 in a direction rearward relative to the individual I. The rescuer R then may continue by connecting the drag strap 22 on the garment 10 of the individual I to the drag strap coupling 21 on the garment 10 of the rescuer R that extends in a direction rearward relative to the rescuer R. In this configuration, the individual I will be facing substantially opposite to a direction of travel of the rescuer R. To accomplish this with the garments 10 shown requires extending the drag strap 22 from a stowed position through an aperture 46 in the outer wear unit 11 of the garment 10 of the individual I, before connecting the drag strap 22 to the drag strap coupling 21 on the garment 10 of the rescuer R.

This advantageous arrangement permits fast mobility and completely hands-free evacuation for both the rescuer R and the individual I. This further allows both persons to be in a position to operate a weapon, safety equipment or to communicate with others, depending on their condition and the circumstances. Indeed, the web or ladder-type structure of the head support portion 29 also helps support and stabilize the head of an individual I as the individual leans back into the drag strap 22. Once again, the deployment of the drag strap 22 from the individual's garment and the connection to the drag strap coupling 21 on the rescuer's garment, as with the aforementioned grasping of the handle 54, likely could be quickly and securely accomplished in a dark setting or otherwise without having the opportunity to view the components being manipulated. In this sense, the operation also may be considered to be eyes-free, which may provide a further significant advantage in the heat of the moment.

Figure 13:
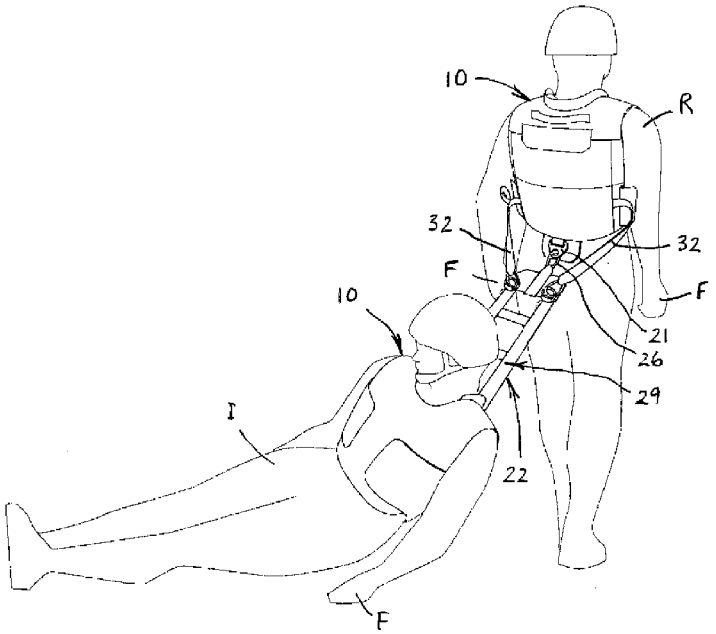
FIG. 13 is a simplified view of a rescuer wearing a garment of FIGS. 1-4 that has a drag strap coupling and auxiliary straps connected to a drag strap on a similar garment worn by an individual seated on a ground surface.

FIG. 13 illustrates yet another mode available for use by the rescuer R, which is more likely to be utilized once the rescuer R is removed from the immediate combat area or if the rescuer R has slightly more time available when initially connecting the respective garments. This mode permits more stable mobility and was discussed above with respect to instances when connectors 30 on a drag strap 22 of a garment 10 that is worn by an individual I are connected to connectors 40 on auxiliary straps 32 of a garment 10 that is worn by a rescuer R. This mode requires providing for each of the respective garments 10 at least two of the aforementioned auxiliary straps 32 that are connected to the torso strap system 19 of the respective garments, and connecting the auxiliary straps on the garment 10 of the rescuer R to the drag strap 22 on the garment 10 of the individual I. The connection may be made by connecting the connectors 40 on the auxiliary straps 32 to the connectors 30 on the drag strap 22. Employment of this configuration will help keep the individual I more stable and less prone to rolling during evacuation. This may further complement the support and stability provided for the head of the individual I by the aforementioned head support portion 29 of the drag strap 22.

Figure 14:
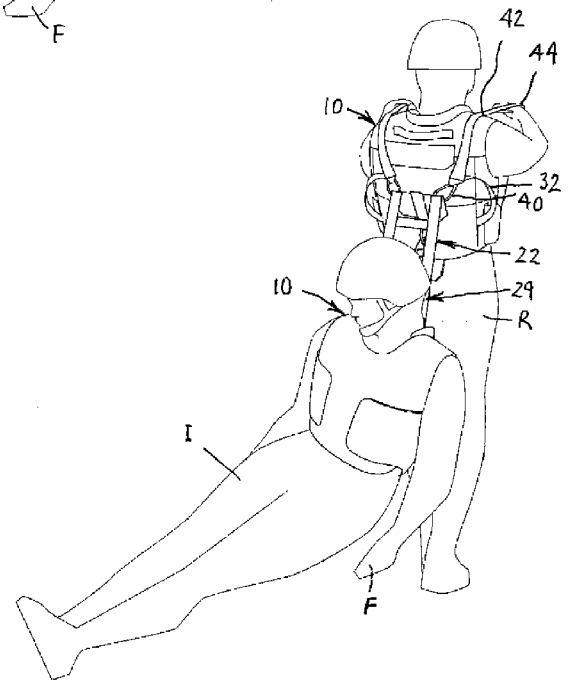
FIG. 14 is a simplified view of a rescuer wearing a garment of FIGS. 1-4 that has a drag strap coupling and auxiliary straps connected to a drag strap on a similar garment worn by an individual seated on a ground surface, and further having the rescuer grasping second segments that extend from first segments of the auxiliary straps, permitting the rescuer to partially lift the individual off of a ground surface.

Turning to FIG. 14, a further mode of evacuation with the device disclosed herein is presented. In this mode, the rescuer R is able to hoist or partially lift the individual I off of the ground surface, to significantly reduce the drag effects on the individual I. This mode provides for increased mobile comfort and reduced likelihood of injury to the individual I from contact with the ground surface. To achieve this mode with use of the example garments 10, the auxiliary straps 32 include a first segment 34 that extends between the torso strap system 19 on the garment 10 of the rescuer R and the drag strap 22 on the garment 10 of the individual I, as well as a second segment 42 that has a first end connected to the first segment 34 and that is further releasably connected along its length to the first segment 34. So equipped, the rescuer R must then act to release along their length the connection between the respective first and second segments 34, 42 of each auxiliary strap 32 on the garment of the rescuer R, while maintaining the connection of the first end of the second segment 42 to the first segment 34. This can be accomplished by having the rescuer R grasp and pull a second end of each respective second segment 42 of the auxiliary straps 32 on the garment 10 of the rescuer R. After separation along the length of the first and second segments 34, 42, continued pulling of the second segments 42 up and over the shoulders of the Rescuer R results in the rescuer R partially lifting the individual I, for more comfortable transport. The first and second segments 34, 42 are shown connected to each other at the second end 38 of the first segment 34. Also, the grasping of the second end of each second segment 42 is facilitated by including an above-discussed grasping portion 44.

FIG. 14 shows the rescuer R having lifted the torso or a portion of the individual I partially off the ground surface. As noted above, to return to hands-free evacuation, the rescuer R could connect the grasping portions 44 at the second ends of the second segments 42 to optional connectors on the front of the garment 10.

Figure 15:
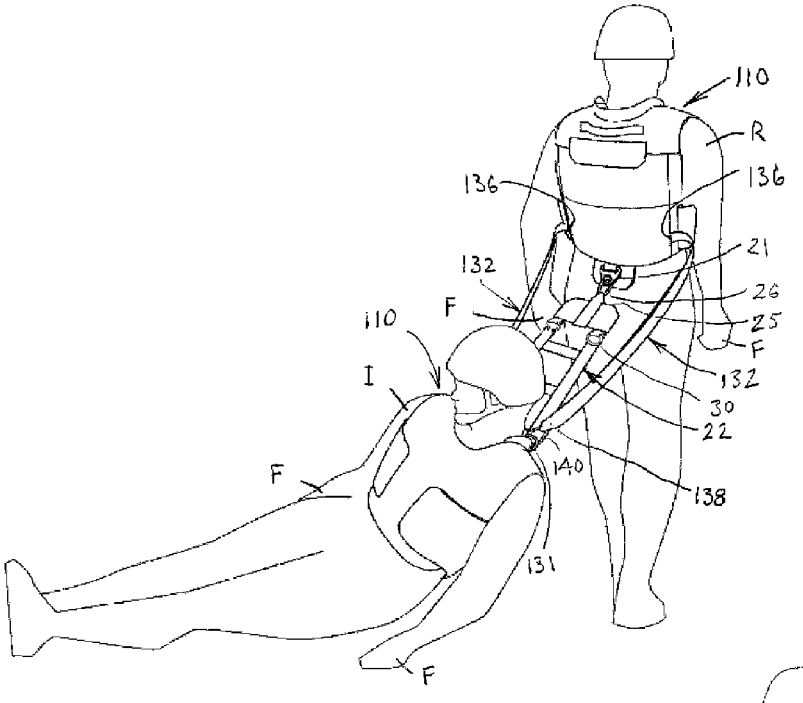
FIG. 15 is a simplified view of a rescuer wearing a second example garment that has a drag strap coupling connected to a second end of a drag strap on a similar garment worn by an individual seated on a ground surface, as well as auxiliary straps on the garment of a rescuer that are connected to a first end of the drag strap on the garment worn by the seated individual.
Figure 16:
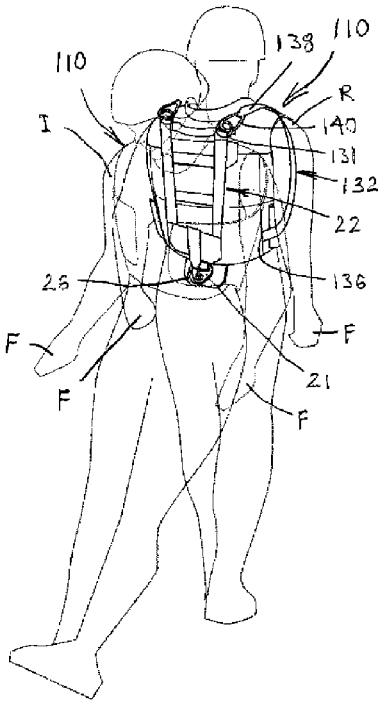
FIG. 16 is a simplified view of the second example garments of FIG. 15 with the auxiliary straps on the garment of the rescuer extending forward and then over the shoulders of the rescuer and rearward to be connected to the first end of the drag strap on the similar garment worn by the individual so as to allow the rescuer to lift the individual from the seated position.

Now turning to FIGS. 15 and 16, second example garments 110 are illustrated for use by both a rescuer R and an individual I to be rescued. Second example garments 110 include several components and features in common with the first example garments 10, but each garment 110 differs with respect to one aspect of the drag strap 22, includes auxiliary straps 132, and differs in the ways one may connect the auxiliary straps 132 on the garment 110 of the rescuer R to the drag strap 22 on the garment 110 of the individual I for increased stability of the individual I, while permitting the rescuer R and individual I to have free hands F during the extraction. For instance, in FIG. 15, the auxiliary straps 132 on the garment 110 of the rescuer R have a first end 136 connected to the torso strap system 19 and a second end 138 that includes a connector 140 that may be connected to the drag strap 22 on the garment 110 of the individual I proximate the first end 24 of the drag strap 22 near the connection of the drag strap 22 to the torso strap system 19. As shown, the drag strap 22 may include connectors 131, similar to the connectors 30 near the second end 25 of the drag strap 22. The connectors 131 may be constructed similarly to connectors 30 which were discussed above with respect to the first example garments 10.

In FIG. 16, the garments 110 are shown in a further connection configuration, where the rescuer R is able to support the individual I above a seated position. A connector 26 on the second end 25 of the drag strap 22 of the garment 110 of the individual I is first connected to a drag strap coupling 21 on the garment 110 of the rescuer R. The rescuer R then extends the auxiliary straps 132 from the rescuer's garment 110 and connects the connectors 140 on the auxiliary straps 132 to the connectors 131 proximate the first end 24 of the drag strap 22 of the garment 110 of the individual I. The rescuer R next stoops down to slide the looped auxiliary straps 132 over the shoulders of the rescuer R. Upon standing, the rescuer R then lifts the individual I to the position shown in FIG. 16, permitting both the rescuer R and individual I to have free hands F during the extraction of the injured individual I.

Figure 17:
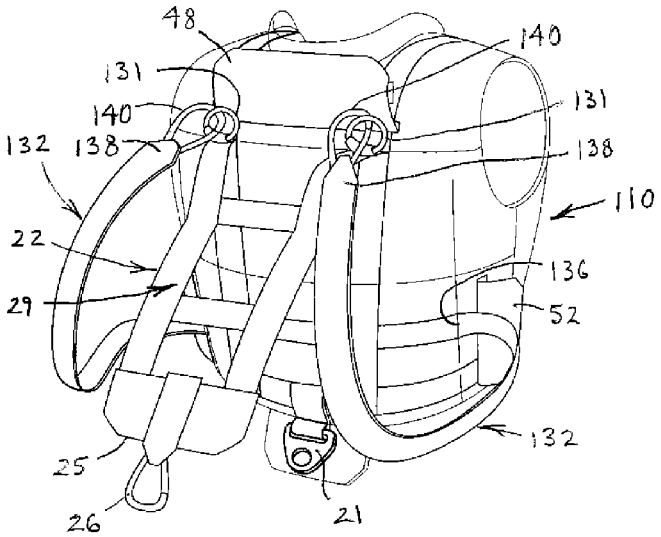
FIG. 17 is a rear perspective view of a garment of the second example shown in FIG. 15, but in a different optional configuration where auxiliary straps extending from the garment of an individual are connected to the drag strap of the same garment, forming a backpack arrangement for the garment worn by the individual and thereby permitting the individual to be lifted by a rescuer.
Figure 18:
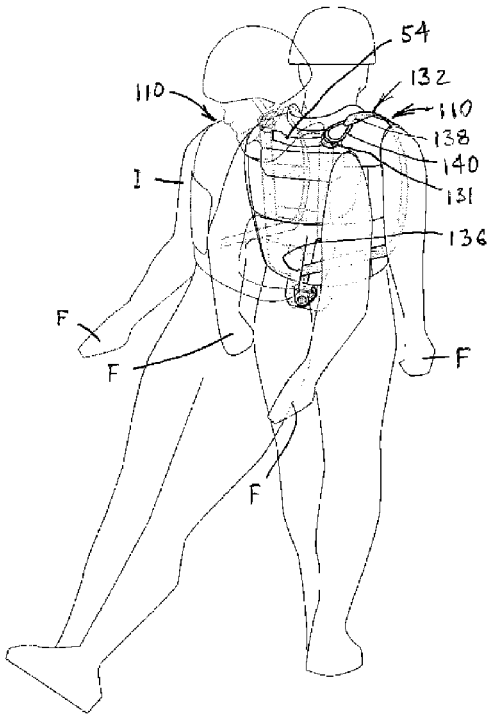
FIG. 18 is a simplified view of a rescuer and an individual wearing garments of the second example with the garment of the individual being in the configuration shown in FIG. 17, and with the rescuer having connected the drag strap of the individual to the drag strap coupling on the rescuer's garment and then slipping the auxiliary straps of the individual over the rescuer's shoulders and standing to lift the individual.

As shown in FIGS. 17 and 18, the second example garment 110 worn by the individual I being rescued may be placed in a configuration that resembles a backpack, for hands free lifting by a rescuer R. The drag strap 22 is extended from the garment of the individual until the connectors 131 are exposed at the first end 24 of the drag strap 22, and the auxiliary straps 132 are extended from the garment of the individual and the connectors 140 at the second end 138 are connected to the respective connectors 131 at the first end of the drag strap 22. This forms the backpack arrangement shown in FIG. 17.

FIG. 18 shows a rescuer R who has manipulated the garment of an individual I to be in the arrangement shown in FIG. 17, and then connected the connector 26 on the second end 25 of the drag strap 22 to the drag strap coupling 21 on the garment 110 of the rescuer R. Finally, the rescuer R has stooped down, slipped the auxiliary straps 132 on the garment 110 of the individual I over the rescuer's shoulders, and then stood up to lift the individual I from the seated position to an more upright position that will reduce the drag effects on the individual I, while permitting both the rescuer R and the individual I to have hands free F to grasp equipment or otherwise help facilitate the extraction of the individual I.

Figure 22:
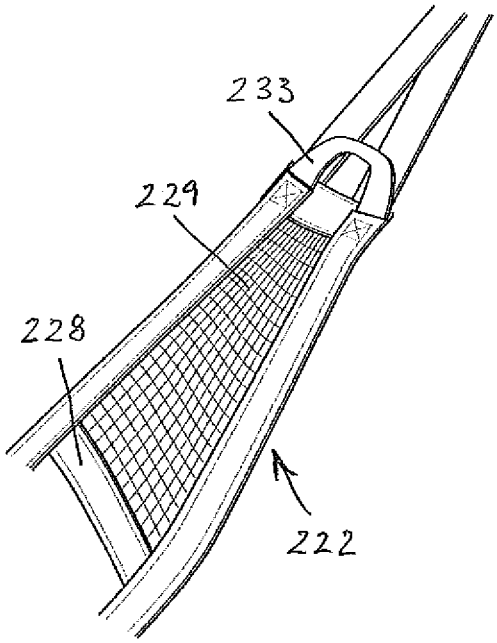
FIG. 22 is simplified rear perspective view of a portion of a drag strap associated with the outer wear unit shown in FIGS. 19 and 20.
Figure 23:
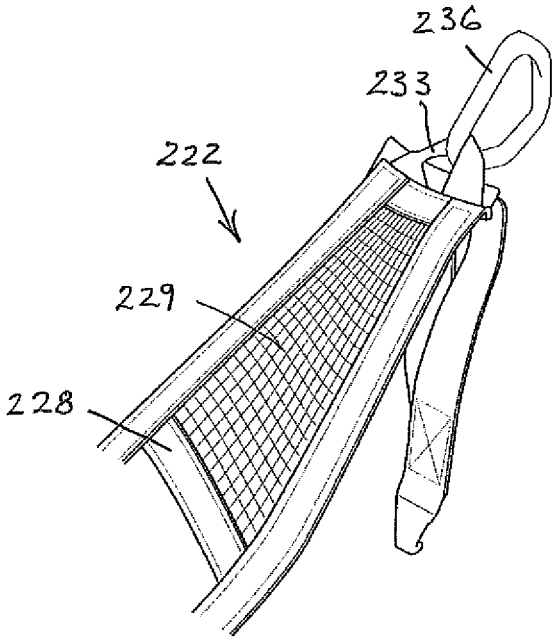
FIG. 23 is a simplified rear perspective view of the portion of a drag strap shown in FIG. 22 and having a connector located at an intermediate position along the drag strap.
Figure 24:
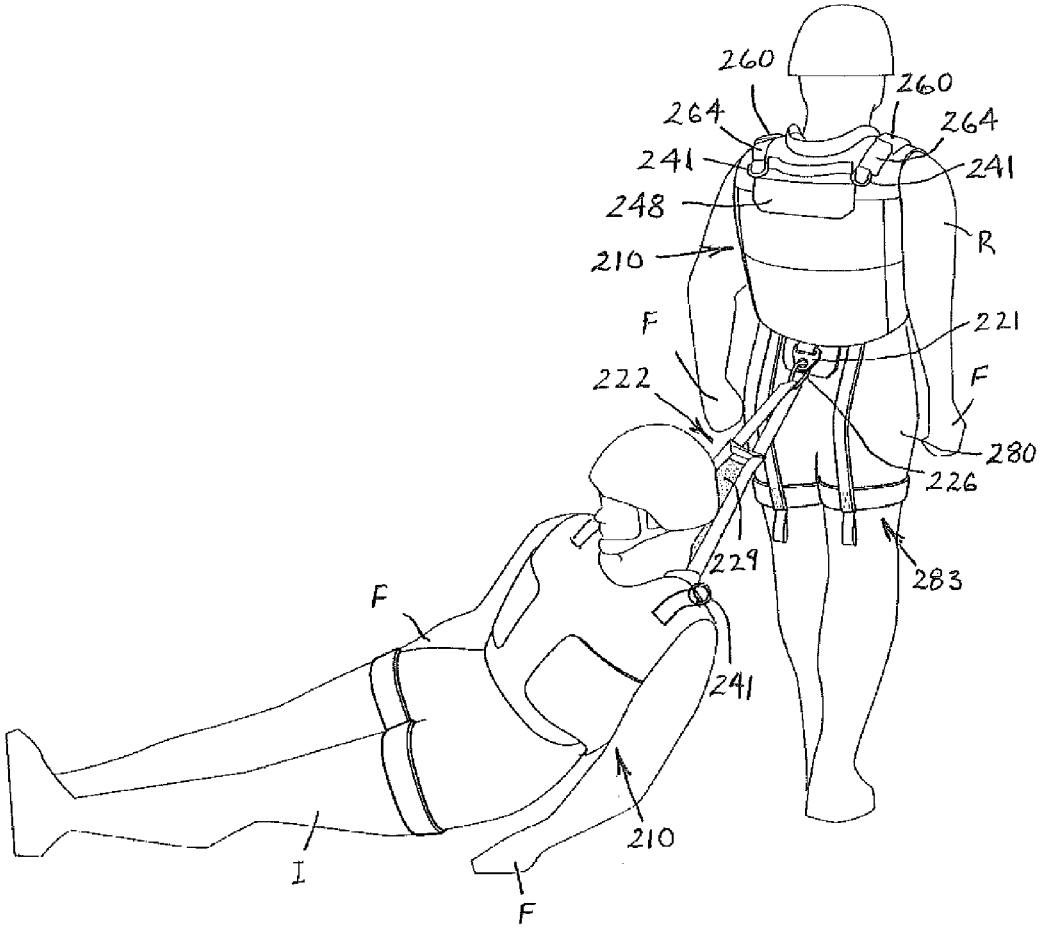
FIG. 24 is a simplified view of a rescuer wearing a garment of FIGS. 19, 20B and 22 that has a drag strap coupling connected to an end of a fully extended drag strap on a similar garment worn by an individual seated on a ground surface.
Figure 25:
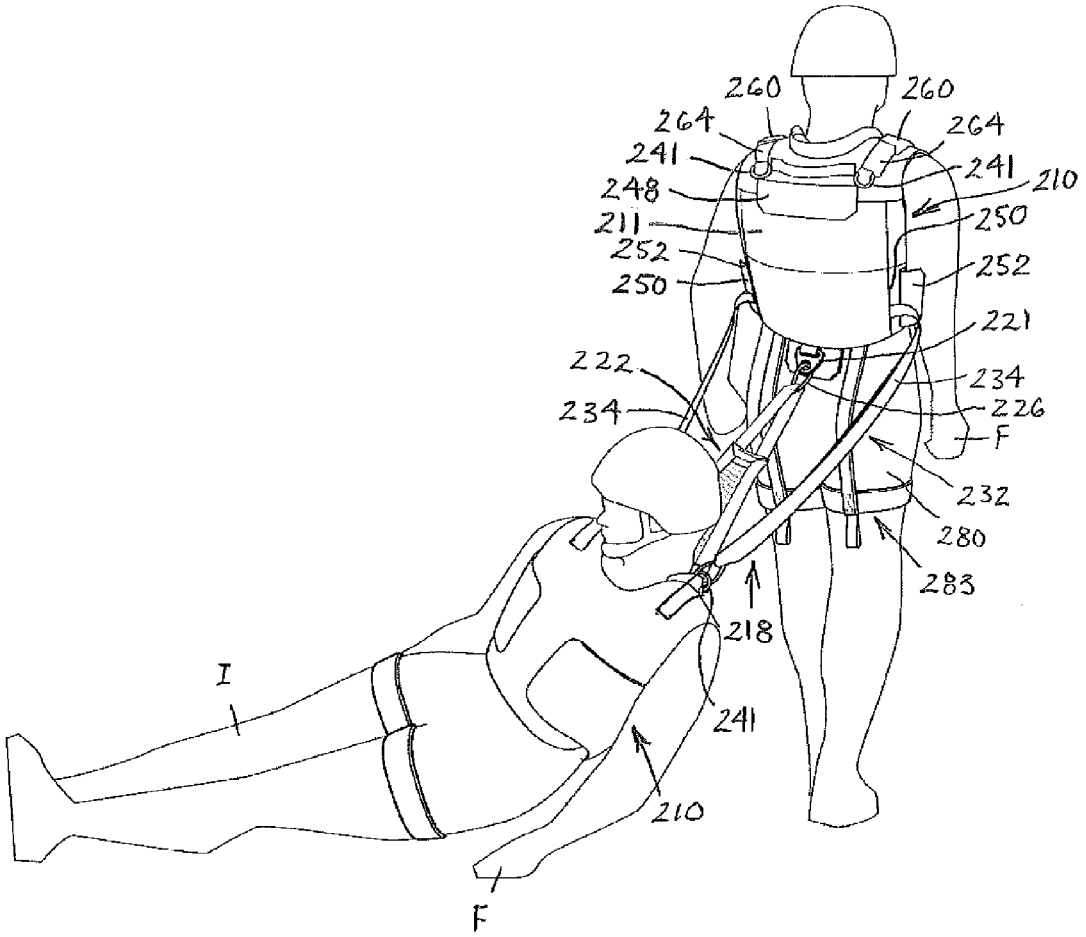
FIG. 25 is a simplified view of a rescuer wearing a garment of FIG. 24 that has a drag strap coupling connected to an end of a fully extended drag strap on a similar garment worn by an individual seated on a ground surface, as well as auxiliary straps on the garment of the rescuer that are connected to connectors located on the upper rear portion of the garment worn by the seated individual.

Now turning to FIGS. 19-28, third example garments 210 are illustrated for use by both one or more rescuers R and an individual I to be rescued. Third example garments 210 include several components and features in common with the first example garments 10, such as the inclusion of an outer wear unit 211, and an evacuation harness 218 connected to the outer wear unit 211, with the evacuation harness 218 having a torso strap system that in this example is concealed by the outer wear unit 211 but may be similar to the torso strap system 19 of the first example garment 10. The outer wear unit 211 also has a rear flap 248 that covers an aperture 246, best seen in FIG. 31, for a rear pouch from which a drag strap may be extended. Similarly, as may be seen in FIGS. 25 and 26, flaps 252 on the sides of the garment 210 cover apertures 250 for side pouches from which auxiliary straps may be extended. However, each garment 210 differs from the first example garment 10 in several ways. For instance, while the drag strap 222 is similarly connected at a first end to the torso strap system, there are structural differences with respect to the drag strap 222, and in the ways one may connect auxiliary straps 232 on the garment 210 of the rescuer R to the garment 210 of the individual I for further increased stability of the individual I, while permitting the rescuer R and individual I to have free hands F during the extraction. For instance, FIG. 24 shows extraction by dragging with a drag strap 222 fully extended from the garment 210 of the individual I and connected to a drag strap coupling 221 on the rear of the garment 210 of the rescuer R by a removable connector 226, similar to that discussed above with respect to connector 26 of the first example. However, added stability may be provided as shown in FIG. 25 by further connecting auxiliary straps 232 extending from the sides of the rescuer's garment 210 to upper connectors 241 connected to the torso strap system and located on the upper rear portion of the garment 210 of the individual. The upper connectors 241 may be of various configurations, such as were discussed above with respect to drag strap coupling 21 or connector 26 at the end of the drag strap 22, and thus for example may be closed rigid rings, or flexible strap loops or may be detachable, such as in the form of a carabiner.

Figure 26:
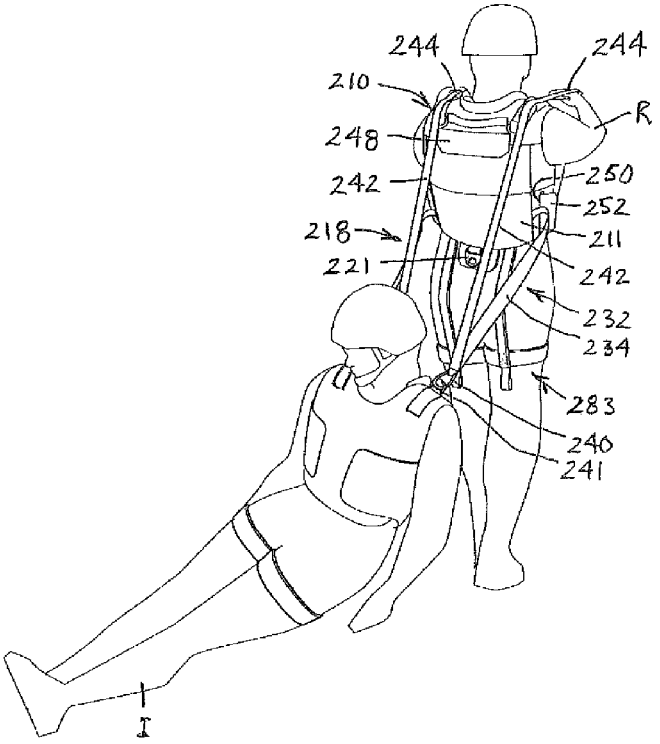
FIG. 26 is a simplified view of a rescuer wearing a garment of FIG. 24 that has a drag strap coupling and auxiliary straps connected to a drag strap and connectors on the upper rear portion of a similar garment worn by an individual seated on a ground surface, and further having the rescuer grasping second segments that extend from first segments of the auxiliary straps, permitting the rescuer to partially lift the individual off of the ground surface

As was shown with respect to the first example garments 10, the auxiliary straps 232 of garments 210 that may extend from the apertures 250 behind the flaps 252 may include first and second segments 234, 242. As such, FIG. 26 is somewhat similar to the view shown in FIG. 14, with the rescuer R using the grasping portions 244 of the second segments 242 that are extended over the rescuer's shoulders to lift or at least reduce the impact of the individual I with the ground surface. In this configuration, the ends of the first segments 234 are connected to the connectors 241 on the upper rear portion of the garment 210 of the individual I being rescued.

Figure 27:
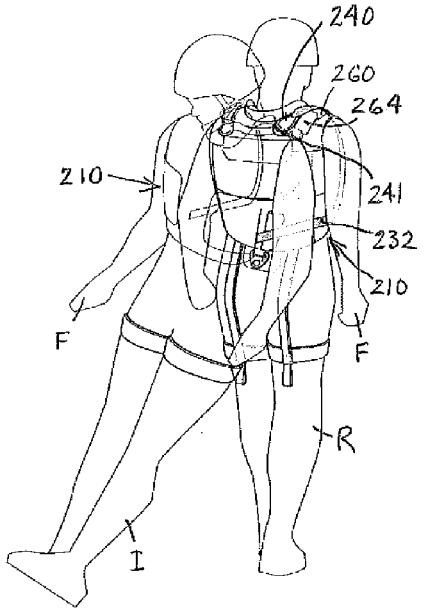
FIG. 27 is a simplified view of the third example garments of FIG. 24, but in a different optional configuration where auxiliary straps extending from the garment of an individual are connected to the connectors on the upper rear portion of the same garment, causing the garment worn by the individual to form a backpack arrangement, thereby permitting the individual to be lifted by a rescuer.

The third example garments 210 also permit a backpack type evacuation, as was discussed with respect to FIG. 16, wherein connectors 240 at the ends of the auxiliary straps 232 on the individual's garment 210 may be looped back to the connectors 241 on the upper rear portion of the garment 210. A rescuer R may then stoop down, back to back with respect to the individual I to be rescued, and position the arms of the rescuer through the looped auxiliary straps 232 to place them over the shoulders of the rescuer. Upon standing, this will allow the rescuer to hoist the individual onto the back of the rescuer for evacuation from the present potentially dangerous location, as best seen in FIG. 27.

Figure 28:
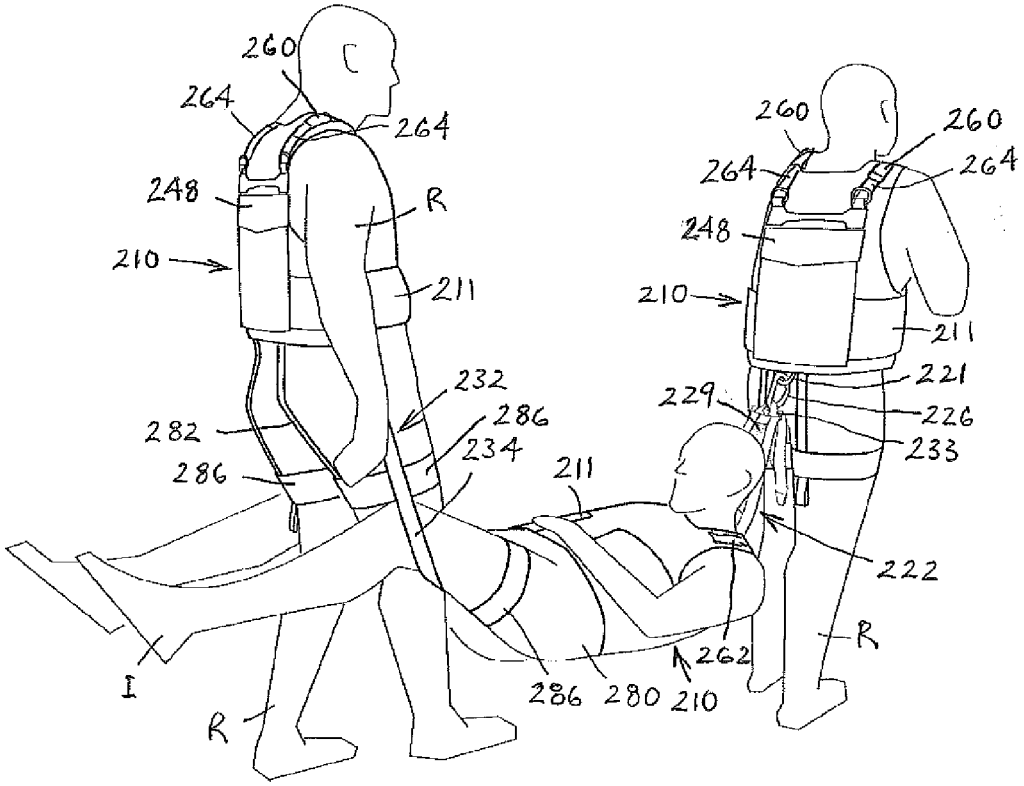
FIG. 28 is a simplified view of the third example garments of FIG. 24, but in yet a further different optional configuration wherein two rescuers are able to lift and evacuate an individual in a substantially horizontal position by having the connector at the intermediate position along the drag strap of the individual connected to the drag strap coupling on the rear of a similar garment worn by a forward rescuer, and having the auxiliary straps extending from a similar garment worn by a rearward rescuer connected to the optional utility harness on the outer wear pant of the individual being rescued.

The garments 210 of the third example also include further optional differences in construction from the prior examples. For instance, as seen in FIGS. 22 and 23, the drag strap 222 includes a head support portion 229, made of mesh, webbing or other suitable light weight, materials having flexible construction, so as to better cradle and support the head of the individual I being extracted. This may be in addition to lateral strap members 228. Also, the drag strap 222 includes a connector 233 at an intermediate location along the drag strap 222. The location used in the present example is proximate the head support portion 229, which permits use of the drag strap 222 in a shorter configuration, such as is shown in FIG. 28, which will be described below in further detail. The connector 233 may be of any of the configurations previously discussed with respect to the drag strap coupling 221 or the connectors 240 or 241.

Figure 19:
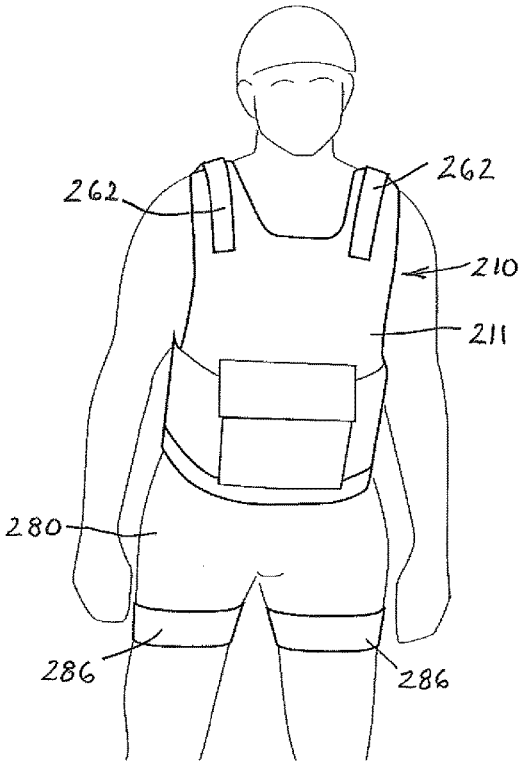
FIG. 19 is a simplified front view of a third example garment that includes an outer wear unit and an evacuation harness worn about the torso, which is shown in combination with an outer wear pant having an optional utility harness connected thereto.
Figure 20A:
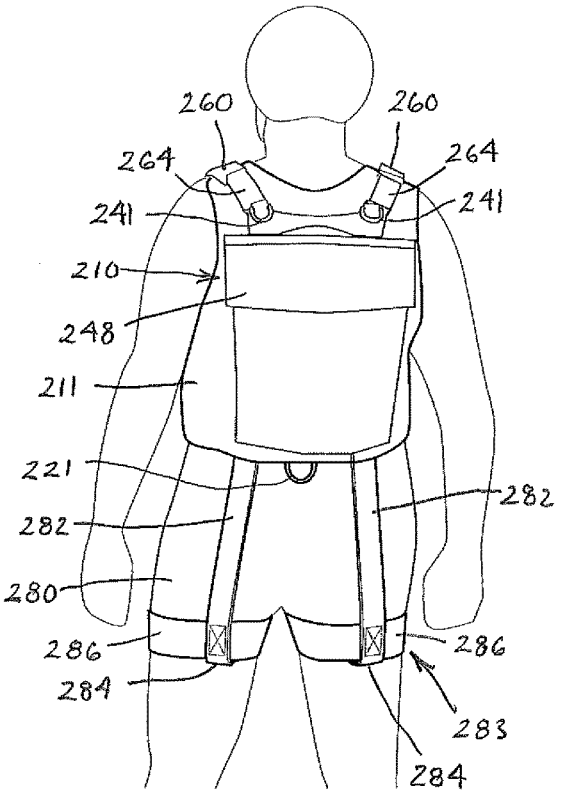
FIG. 20A is a simplified rear view of the third example garment, which shows a first configuration for a rear strap extending from the outer wear unit as part of an optional leg strap system of a further utility harness.

Also, as seen in FIGS. 19 and 20A, the garments 210 include shoulder straps having releasable buckles 260 that are connected to strap segments 262, 264 that collectively extend over the shoulders of a user. The shoulder straps having releasable buckles 260 may make donning and doffing of the garments 210 more convenient and may provide for adjustment of the effective lengths of the strap segments 262 and/or 264 to better fit the garment 210 on the torso of different sized individuals.

Figure 20B:
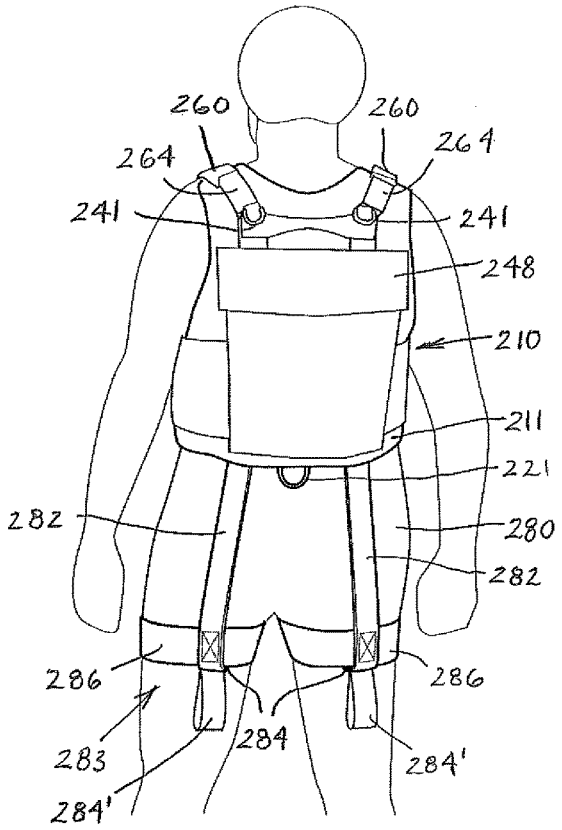
FIG. 20B is a simplified rear view of a modified version of the third example garment, which shows a second configuration for a rear strap extending from the outer wear unit as part of an optional leg strap system of a further utility harness having loops extending downward from the leg strap system.

Further optional differences in the third example may be seen in FIGS. 19 20A and 20B with respect to the use of additional retaining straps that extend along and around the legs of a user, such as in a leg strap system 283. Such straps may include releasable buckles or other fasteners that may permit adjustment to better fit a user. The straps also may extend to locations of connection to the front and rear of the torso strap system, respectively. For instance, as seen in FIG. 20A, the vertically extending straps 282 that are connected to straps 286 that encircle the user's thigh assist in keeping the garments 210 in an appropriate position relative to the user's torso. Optional straps and connectors may be added to the front of the garment 210 to provide further locations for connecting the first or second segments 234, 242 of the auxiliary straps to a like garment, which may be employed in an evacuation of an individual, or for other general use. Also, it will be appreciated that straps could be formed of multiple segments or as a single continuous length of strap extending between and connected to positions on the front and rear of the torso strap system.

Figure 29:
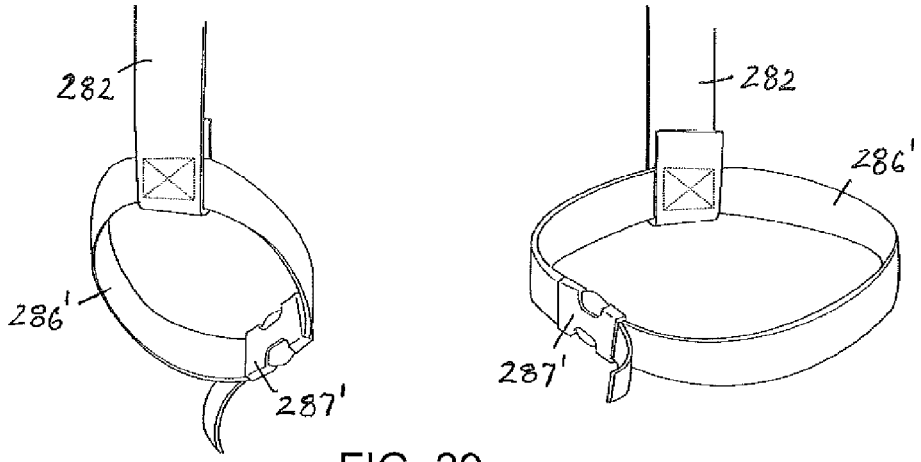
FIG. 29 shows rear and front perspective views of optional leg straps for use with the garment of FIGS. 19 and 20A.

The garments 210 also may be used in combination with additional components to assist in particular types of extractions. For instance, the user also may don outer wear pants 280 that can be configured to provide at least one strap 286 around a thigh region, although it would be preferred to include a strap around each thigh. Use of the term pants is intended to be generic with respect to a unit that covers at least a portion of a lower body of a user and is not intended to be restrictive with respect to the construction of a garment that may be in the form of full length pants, shorts, briefs or simply in the form of a harness constructed of straps or other materials that may cover portions of the pelvis and/or upper leg regions. Also, the strap 286 may be sewn to the pants or optionally may be formed as a loop through which an individual extends a leg to don the strap 286. Indeed, as shown in an alternative configuration in FIG. 29, the strap 286' may be formed in a loop but may include a buckle 287' for ease of donning and doffing, and the buckle 287' may permit adjustment of the length of strap 286' that encircles the individual's thigh.

As seen in FIGS. 19, 20A and 20B and mentioned above, a leg strap 282 may be part of a leg strap system 283 located along the rear of the thigh region to provide a further utility harness having one or more additional locations to connect auxiliary straps 232 of a rescuer R to an individual I being rescued. In FIG. 20A, leg straps 282 are shown as being connected at an upper end to the torso strap system at the rear of the outer wear unit 211, extending downward, and terminating connectors that are shown in this example in the form of loops 284. Connector loops 284 are formed by sewing a portion of the strap that has been looped back onto itself. To help keep the leg straps 282 located along the rear of the thighs, in this example, thigh straps 286 encircle the respective thighs and pass through the loops 284 at the distal ends of the straps 282. The straps 286 also may include other connectors to permit the loops 284 to be separated from the straps 286 and/or adjustment elements to permit adjustment of the length of the straps 286 to better fit the thigh of the individual I. Also, the straps 286 may be used as connectors of the leg straps 282. Still further, FIG. 20B shows alternative ends of the leg straps 282, which include further loops 284' that may be gripped by an individual or may be used as connectors through which other straps may pass, or to which other straps, such as auxiliary straps 232 of a rescuer may be fastened.

Figure 21:
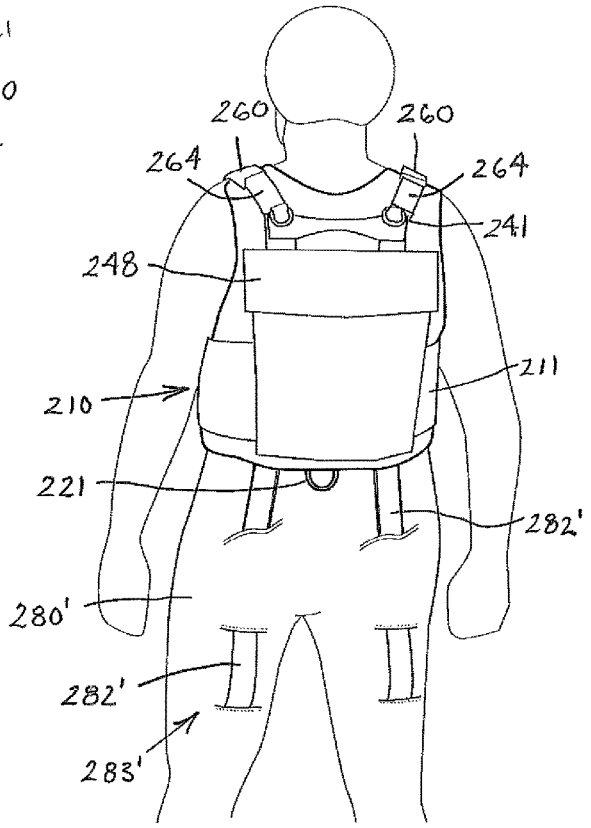
FIG. 21 is a simplified rear view of a further configuration for rear straps associated with an outer wear pant having a leg strap system of a utility harness.

FIG. 21 shows an alternative means of providing a leg strap 282' of a leg strap system 283' wherein the leg strap 282' is connected to an upper leg portion of the pants 280'. The leg strap 282' is available for connection to other straps. Also, as previously noted in part with respect to FIG. 29, it will be appreciated that the straps that encircle the thigh may be constructed in alternative ways. Indeed, the straps also may have configurations that help disperse the loads applied to or by the straps, such as by making them wider or thicker. Further, they may be constructed of any number of materials, but preferably are flexible and permit a limited range of expansion when donned, such as may be permitted by nylon, neoprene or other materials that may be held in place by use of hook and loop fasteners or by being a continuous cuff that is slid up the leg and into position over the thigh.

It will be appreciated that at least one further alternative that is contemplated includes a leg strap that is connected directly to the rear of each pant leg of the outer wear pants, but does not extend upward and connect to the garment 210. In such a configuration, the leg straps of a leg strap system that forms a further utility harness may be connected to the outer wear pants, such as by being sewn along the inside of each pant leg, or along the outside of each pant leg, in which case the leg strap need not but could extend downward past the lower end of the thigh, so as to help disperse loads applied to the strap or to help elevate the lower portion of the leg during an evacuation by more than one rescuer. Leg straps connected directly to the outer wear pants also could include connectors in such configurations as were discussed above with respect to other connectors on the garment 210 or the other example garments. Indeed, provision for a leg strap in a pant leg of an outer wear pant may provide other uses in such tactical clothing.

FIG. 28 shows a highly advantageous extraction position in which the leg straps 282 may be used to be able to move an individual I in a substantially horizontal position while lifted above a ground surface by two rescuers R. In this position, the forward rescuer has the connector 233 at the intermediate position of the drag strap 222 on the individual's garment 210 connected to the drag strap coupling 221 at the lower rear of the forward rescuer's similar garment 210, thereby supporting the upper torso and head above the ground surface. The rearward rescuer is positioned between the legs of the individual I and has first segments 234 of the auxiliary straps 232 connected to the leg strap system 283, such as by passing through the loops 284 of straps 282 at the rear of the individual's thighs or by connecting to the loops 286 around the thighs, thereby supporting a portion of the torso and the lower body of the individual I above the ground surface. The auxiliary straps 232 also could be looped through the leg strap system 283 as noted and then may extend further so as to have ends of the auxiliary straps 232 connected to optional connectors on the front of the garment 210. It will be appreciated that in either configuration, this positioning will permit two rescuers R to readily evacuate a wounded or otherwise injured individual I, while permitting all three persons to have their hands free to aid in protecting themselves or carrying other objects or equipment. It also will be appreciated that this arrangement could utilize three rescuers by having the same arrangement for the forward rescuer but providing two rearward rescuers, with each rescuer R being located adjacent an outer side of a leg of the individual I. Each rearward rescuer R would have an auxiliary strap 232 connected to the leg strap system 283 of the individual I, such as at the strap 282, for example at a loop 284, or at a strap 286 encircling a thigh, or to optional connectors. This would reduce the respective load per rescuer R and permit more free movement of the legs of the rearward rescuers R. This three rescuer R configuration may be particularly advantageous depending on the injuries sustained by the individual I, or the size of the individual I relative to the rescuers R.

Figure 30:
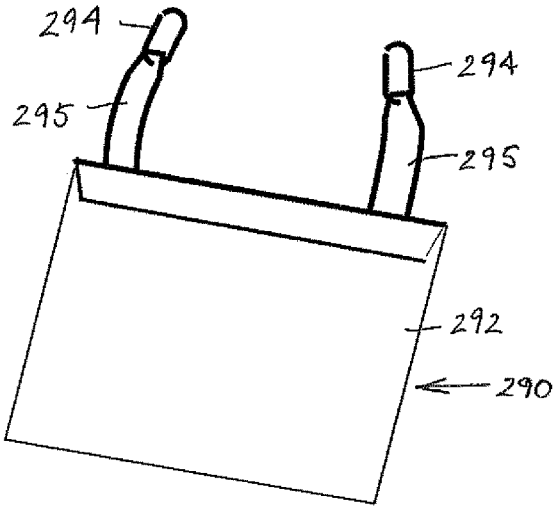
FIG. 30 is a simplified view of a tow tarp shown in a folded position for compact stowing within the garment.
Figure 31:
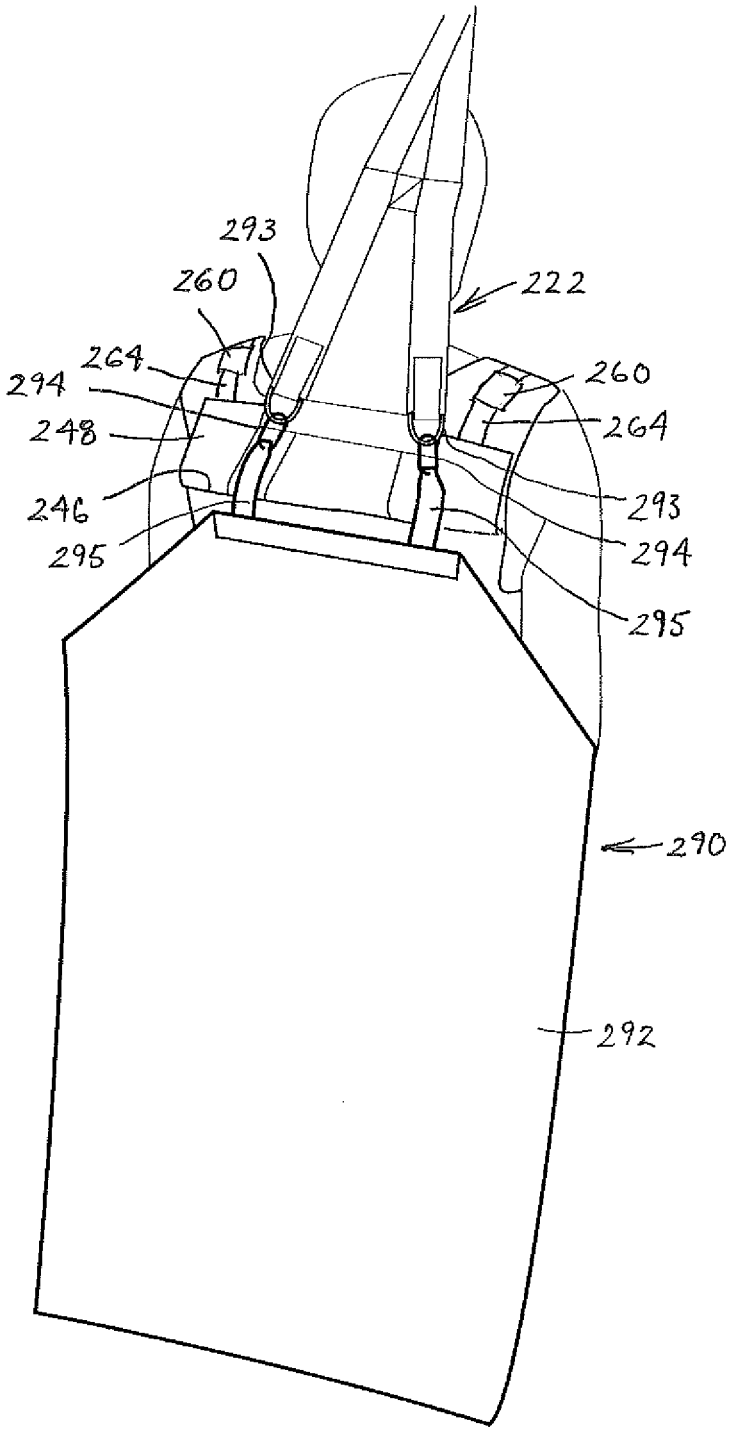
FIG. 31 is a simplified rear view of a the tow tarp of FIG. 30 shown in an unfolded position and showing the connection of the tow tarp to the connectors on the garment of FIG. 24.

Another component with which the garments 210 or the like may be used is a tow tarp 290, as may be seen in FIGS. 30-31. The tow tarp 290 includes a sheet material 292 that is intended to protect the individual I from further injury while being evacuated over hard and/or rough surfaces. The tow tarp 290 may be constructed of any number of materials but preferably is light weight and flexible, permitting it to be stowed in a pouch of the garment when folded, as may be seen in FIG. 30. When unfolded or unrolled for use, the tow tarp 290 is intended to extend at least from its connectors 294 and strap segments 295 that may be connected to the connectors 293 at the proximal end of the drag strap 222, to beyond the seat of the individual I. It will be appreciated that extending further down the legs of the individual, such as is shown in FIG. 31, may be advantageous to provide still further protection during an evacuation that requires dragging the individual along the ground surface.

Figure 32:
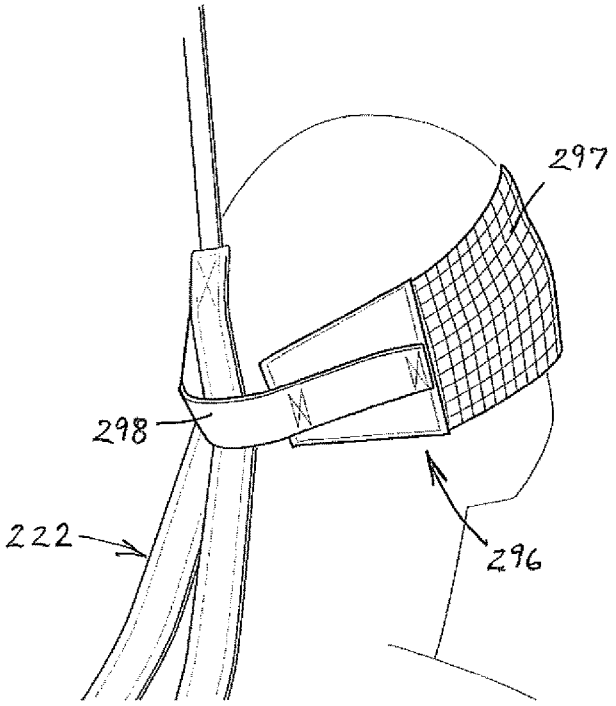
FIG. 32 is simplified rear perspective view of an optional head stabilizing device that is wrapped around an individual's head and connected to the drag strap extending from the same individual's garment of FIG. 24.

One further component that may be used in combination with the garment 210 is a head restraint 296, as seen in FIG. 32. The head restraint 296 may include a band 297 to grasp and hold the head of the individual I being evacuated over a broad area and a fastening strap 298 that connects the band 297 to the drag strap 222. The fastening strap 298 preferably includes an adjustment mechanism, such as a buckle or hook and loop fastening segments, to accommodate heads of different sizes and the potentially of additional bulk, as may be present with respect to bandages or swelling. The head restraint 296 may be used to hold the head steady, which may be very important depending on the extent of the individual's injuries or if the individual is unconscious.

Now turning to FIGS. 33-39, a fourth example garment 310 is illustrated for use by both one or more rescuers R and an individual I to be rescued. Fourth example garments 310 include several components and features in common with the first example garments 10, such as the inclusion of an outer wear unit 311 having at least a torso portion 312, and an evacuation harness 318. The outer wear unit 311 and evacuation harness 318 may be constructed of similar materials to those mentioned above for the other garments, and may be constructed in a similar manner to the prior examples, other than as noted herein.

Figure 2:
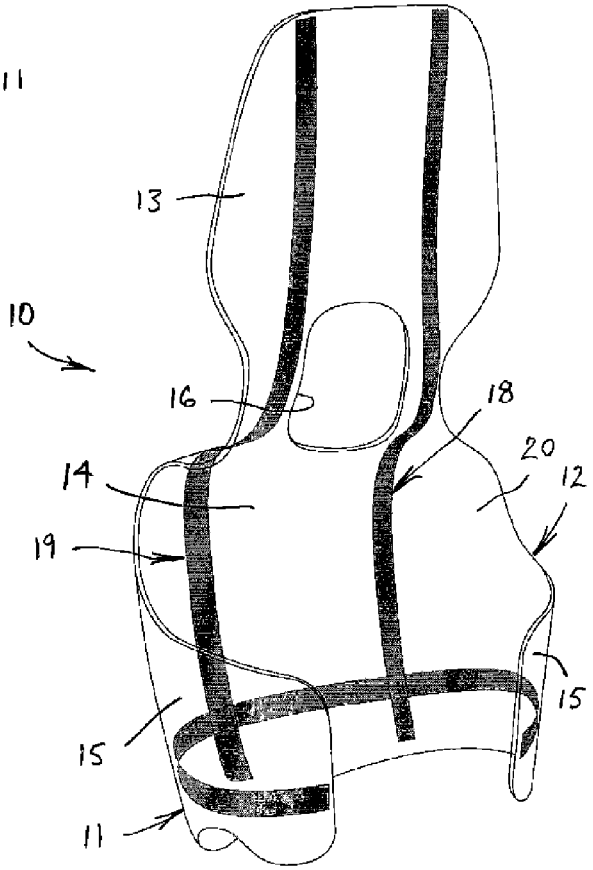
FIG. 2 is a front perspective view of the garment of FIG. 1 in an open position, prior to donning.
Figure 3:
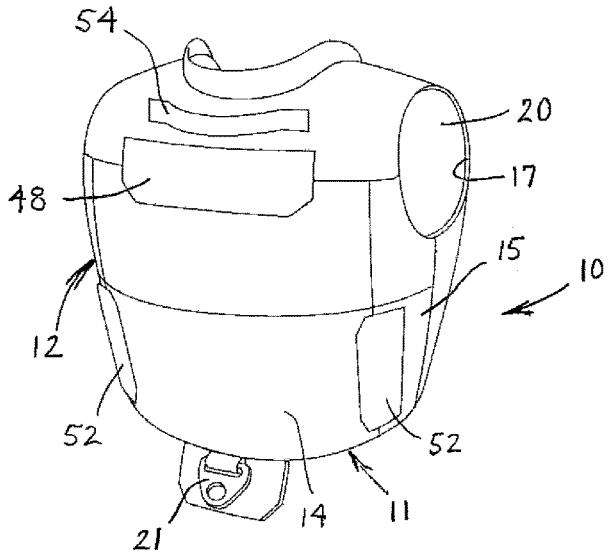
FIG. 3 is a rear perspective view of the garment of FIGS. 1 and 2, showing a drag strap coupling extending rearward relative to the outer wear unit.

As is shown for instance in FIGS. 1 and 2 for the first example garment 10, the evacuation harness 318 of the fourth example garment 310 includes a torso strap system that may be similar to that shown for the prior examples and that is connected to the outer wear unit 311. The torso strap system and most of the evacuation harness of this example are concealed by the outer wear unit 311. In this example, the outer wear unit 311 may include a centrally located rear pouch with a rear flap that covers an aperture, which optionally may conceal a drag strap. While such a flap, aperture, pouch and drag strap may optionally be included, they are not required for use of example garments 310, which will be shown and described with respect to use of alternative components and methods of connection for extraction of an injured individual.

Figure 33:
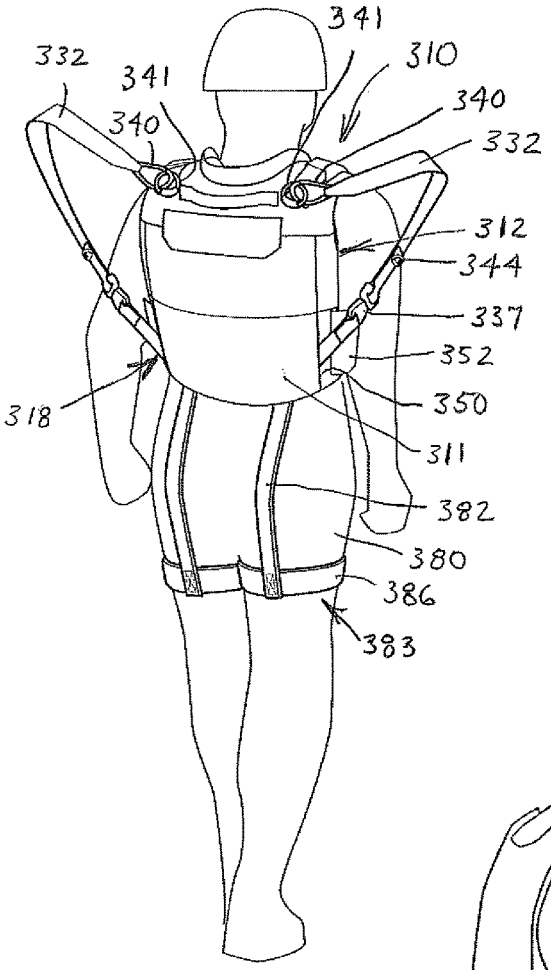
FIG. 33 is a simplified rear perspective view of a user wearing a fourth example garment that includes an outer wear unit and an evacuation harness worn about the torso, which is shown in combination with an outer wear pant having an optional utility harness connected thereto, and having auxiliary straps that extend from the outer wear unit having their distal ends connected to connectors located on an upper portion of the outer wear unit, and with the auxiliary straps having releasable buckle.
Figure 34:
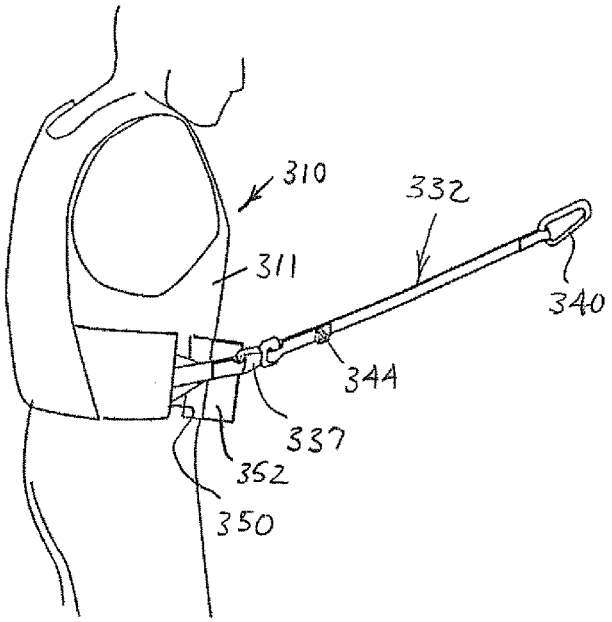
FIG. 34 is a simplified side perspective view of the fourth example garment of FIG. 33 showing one of the auxiliary straps extended from the outer wear unit.

As may be seen in FIG. 33, the torso strap system includes at least two upper connectors 341, wherein when the garment is worn by a user, the upper connectors 341 are proximate an upper portion of the outer wear unit 311. The evacuation harness 318 further includes at least two auxiliary straps 332 that are connected to the torso strap system and are laterally spaced apart. The auxiliary straps 332 are stowable within and selectively extendible from the outer wear unit 311. Indeed, as shown in FIG. 34, a flap 352 on the side of the outer wear unit 311 of garment 310 covers an aperture 350 for a side pouch from which an auxiliary strap 332 may be extended. The example garment 310 shows optional, alternative auxiliary straps 332 that differ from the auxiliary straps of the prior examples. However, it will be appreciated that these alternative auxiliary straps 332 may be employed in any of the preceding example garments and may be used in alternative ways.

Of particular note, each alternative auxiliary strap 332 may include a releasable buckle 337, which may be of alternative detachable constructions and effectively provides a quick disconnect feature if it is necessary to selectively rapidly detach an auxiliary strap 332 from a torso strap system of a user. Each auxiliary strap 332 also may include at least one connector 344, such as a D-ring or loop along the length of the auxiliary strap 332. Each auxiliary strap 332 further may include a connector 340 at the distal end of the auxiliary strap 332, such as a releasable connector in the form of a carabiner, a clasp or other device that is releasably connectable and can be used in various configurations. For instance, as shown in FIG. 33, the auxiliary straps 332 may be extendible from the outer wear unit and connectable to the upper connectors 341. Thus, the connectors 340 at the distal ends of the auxiliary straps 332 may be connected to the respective upper connectors 341 on the same garment 310, at positions on the same side of the garment, as seen in FIG. 33, or on the laterally opposite side of the garment, as seen in FIG. 38.

Indeed, the alternative auxiliary straps 332 of garment 310 permit additional configurations and adaptations for extractions when using similar garments 310 in a rescue garment system, whether the users are wearing only the outer wear units 311 or also are wearing an outer wear pant 380. Consistent with the garment constructions in the prior examples, an outer wear pant 380 may include a leg strap system 383 that may include at least one leg strap extending along at least a portion of a thigh region of the outer wear pant 380. Thus, the at least one leg strap may be a leg strap 382 extending downward along a portion of a user's thigh, a strap 386 that encircles a portion of the user's thigh, or may include both or additional strap portions. The leg strap also may include a connector or buckle 387, such as is shown in FIG. 39.

Figure 35:
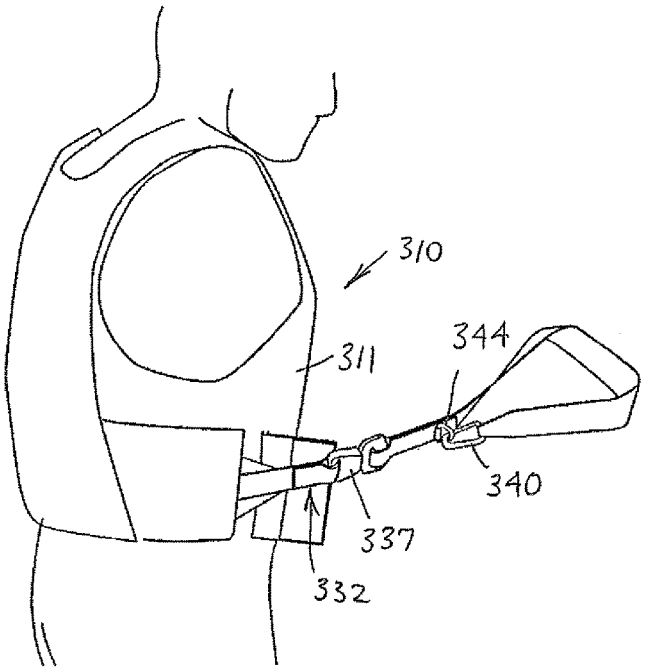
FIG. 35 is a simplified side perspective view of the auxiliary strap shown in FIG. 34, with the auxiliary strap formed into a loop by connecting a releasable connector at the distal end of the auxiliary strap to a connector along the length of the auxiliary strap.
Figure 36:
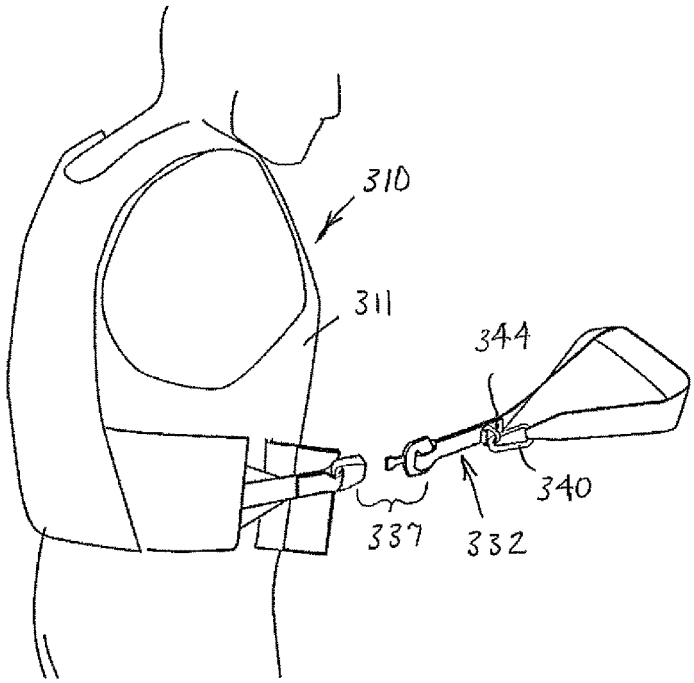
FIG. 36 is a simplified side perspective view of the auxiliary strap shown in FIG. 35, with a releasable buckle having been opened to disconnect a portion of the auxiliary strap.
Figure 38:
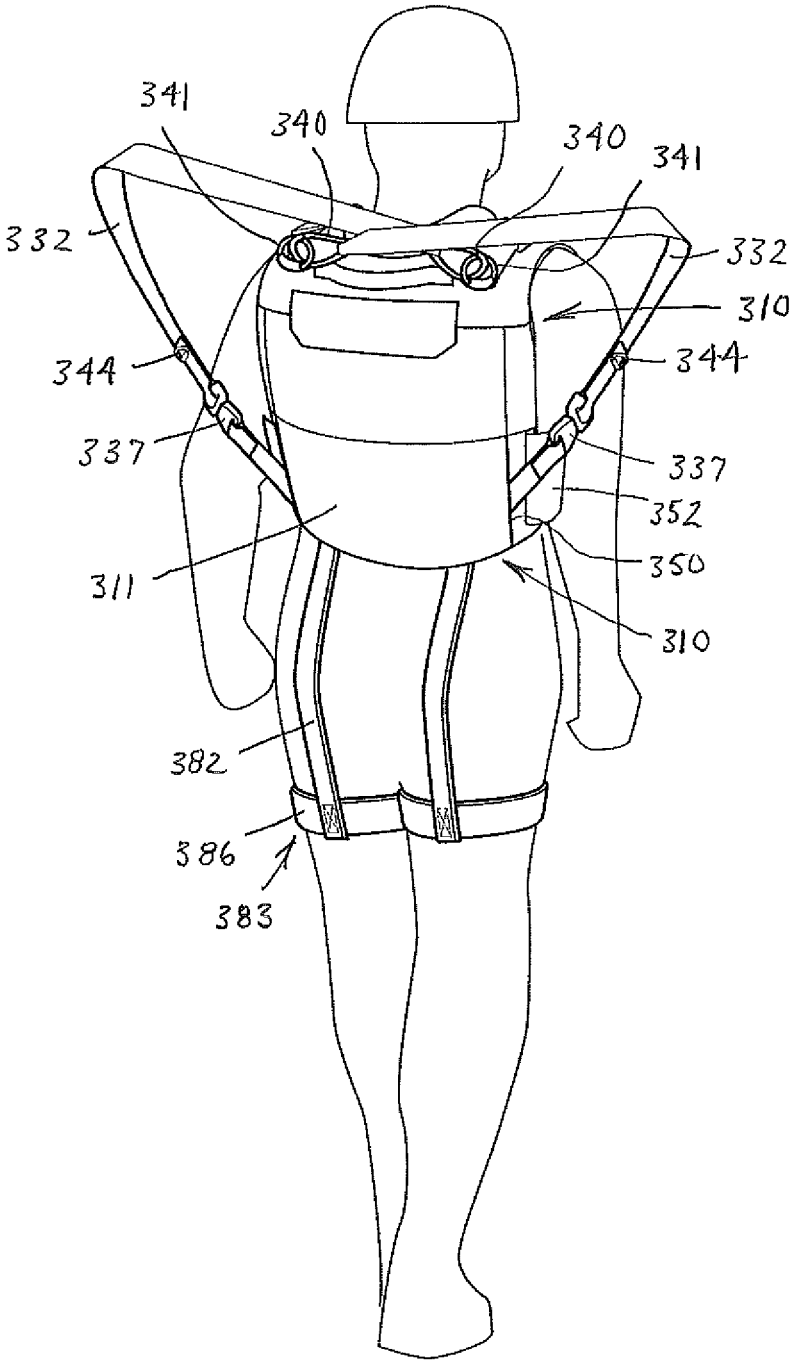
FIG. 38 is a simplified rear perspective view of the garment of FIG. 33, with the auxiliary straps extending from the outer wear unit and having their distal ends connected to connectors located on an upper portion of the laterally opposite side of the outer wear unit.

The alternative configurations for extractions may be due in part to the ability to form a loop with the auxiliary strap 332 when it is extended and connected to the connectors 341 on the upper portion of the outer wear unit 311, as noted with respect to FIGS. 33 and 38. It also may be due to the opportunity to form a loop along the auxiliary strap 332 by connecting the connector 340 at the distal end of the auxiliary strap 332 to the connector 344 that is positioned along the length of the auxiliary strap 332, as shown in FIG. 35. It will be appreciated that the connectors 340 and 344 may be constructed as fixed ring, loop or releasable connectors, and may be used for connection to other connectors or portions of straps on the same garment 310 or on a similar garment 310 of another user, as desired. Moreover, the releasable buckle 337 permits use of an auxiliary strap 332 while reserving the option to rapidly detach from a torso strap system of an individual or a rescuer, such as in the event of an emergency, or when reaching a destination where detachment is needed to permit treatment of the injured individual.

Figure 37:
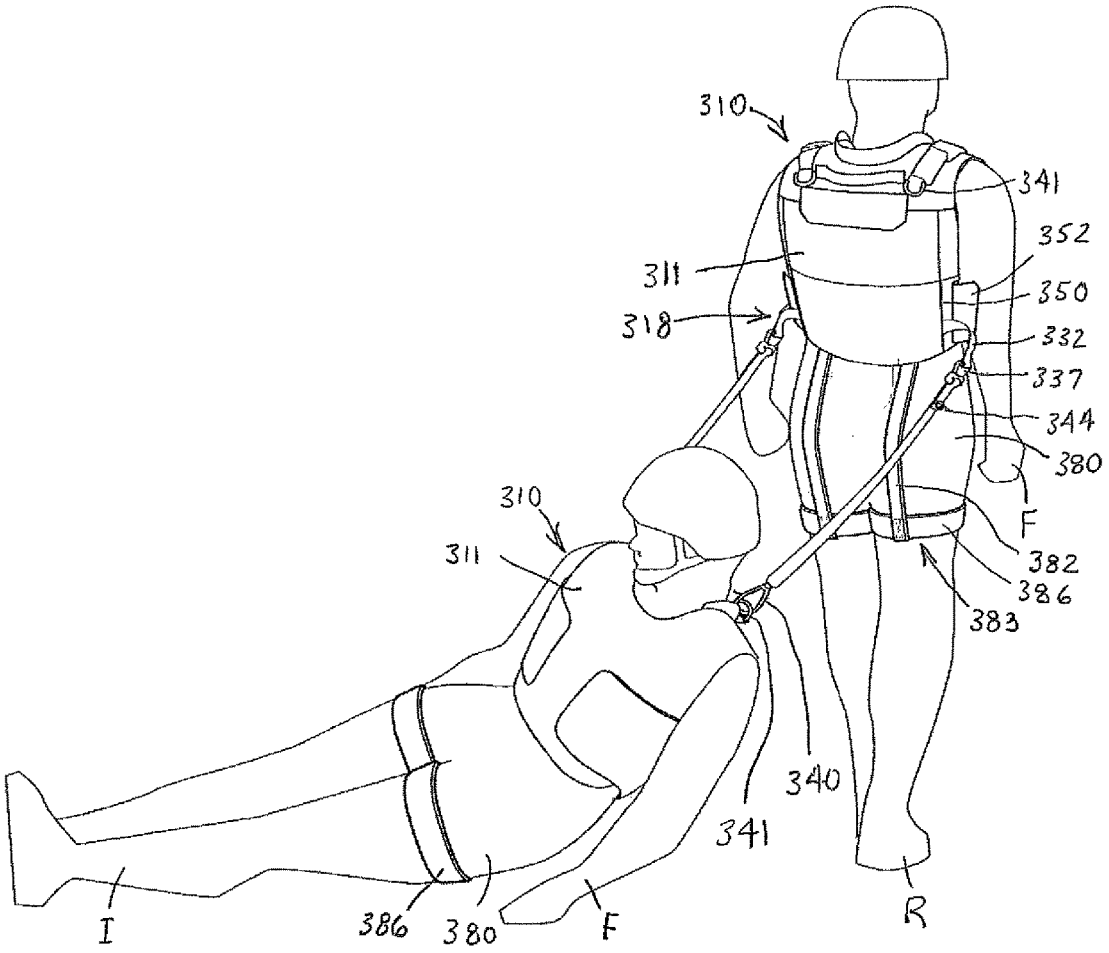
FIG. 37 is a simplified rear perspective view of a rescuer wearing a garment of FIG. 33 that has the distal ends of the auxiliary straps that extend from the outer wear unit connected to connectors on an upper portion of a similar garment worn by an individual seated on a ground surface.

Thus, when two similar garments 310 are worn by multiple users, a rescuer R may connect to a wounded individual I and drag the individual, as shown in FIG. 37. This is possible when the connectors 340 at the distal ends of the auxiliary straps 332 extending from the outer wear unit 311 of the rescuer R are connected to the connectors 341 at the upper portion of the outer wear unit 311 of the individual I. This permits hands F of the users to be free for other purposes, as previously discussed.

Figure 39:
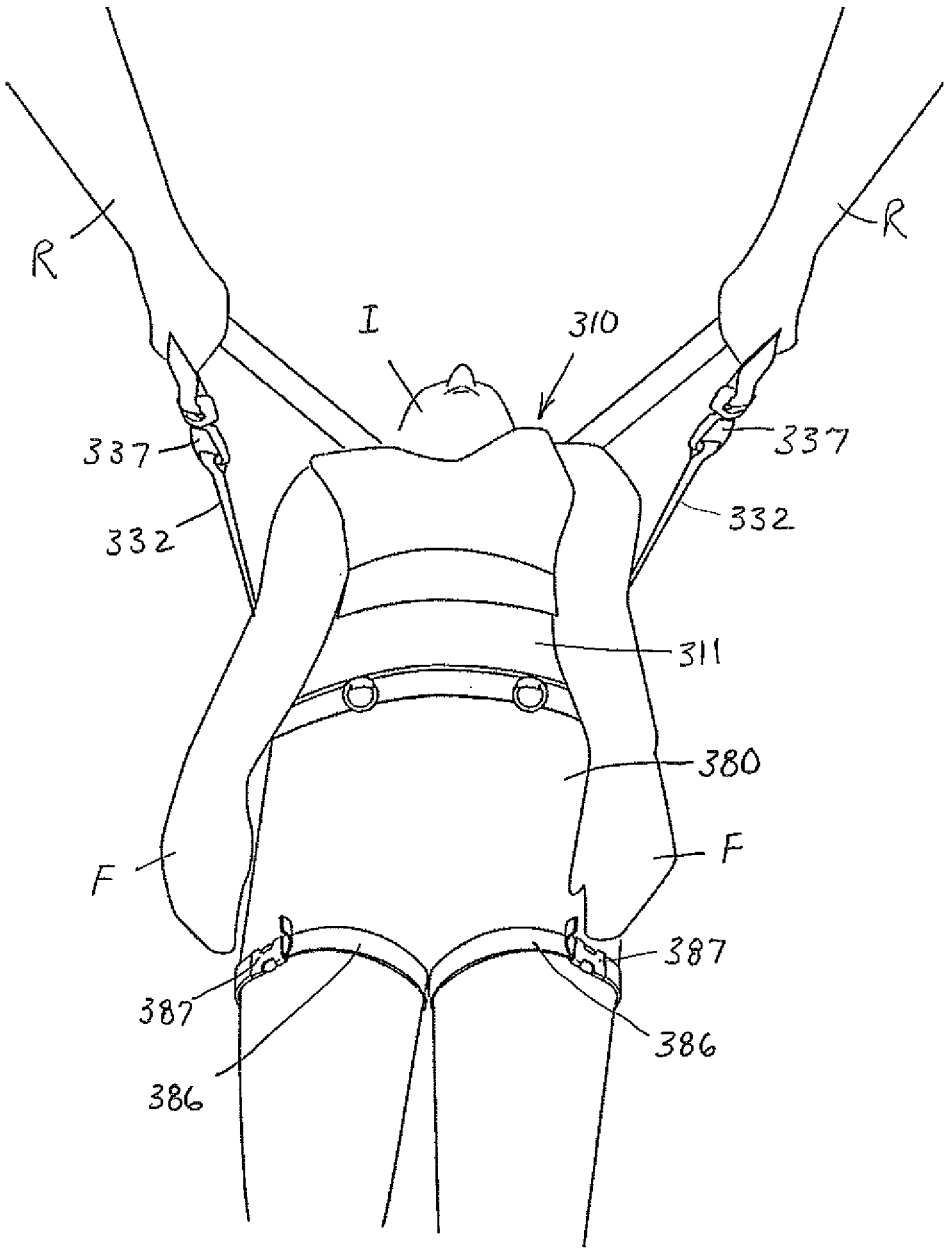
FIG. 39 is a simplified rear perspective view of a wounded individual wearing the fourth example garment and being lifted by two rescuers by use of grasping the auxiliary straps on the individual's garment, which are in the crossed and connected configuration shown in FIG. 38.

When a wounded individual I has the auxiliary straps 332 connected in the crossed pattern shown in FIG. 38, it is possible to lift and carry or drag the individual I in the manner shown in FIG. 39, while the crossed auxiliary straps 332 may offer support for the head of the individual. Thus, in FIG. 39, two rescuers R that may be wearing similar garments 310 each may grasp a looped auxiliary strap 332 of the individual's garment 310 to lift the individual's upper body, to more conveniently drag the individual. Additionally, the individual I may be completely lifted for extraction by adding at least one further rescuer positioned between the legs of the individual I, so as to lift the lower body of the individual. For instance, a third rescuer may directly grasp the legs of the individual I to assist in carrying. Alternatively, two rescuers may assist by lifting the lower body of the individual I, when being positioned immediately to the sides of the individual. The two additional rescuers each may directly grasp a leg of the individual I for lifting and carrying, or may use a hands-free approach by using an auxiliary strap 332 that has been formed into a loop around a leg of the individual I, with the loop being formed by use of the connectors 340 and 344, as shown in FIG. 35. In this configuration, the additional rescuers continue to have their hands free for other purposes, and may quickly detach themselves from the injured individual I by use of the releasable buckles 337, if necessary.

It will be appreciated that the garments 310 of the fourth example may be used in various methods of connecting an individual to at least one rescuer, or to at least two rescuers, by extending and connecting the appropriate straps of the respective garments 310.

It will be understood that the examples described above are illustrative of some of the applications of the principles of the present subject matter. Thus, while examples were provided and discussed with respect to armored vests and tactical pants, it is contemplated that garments may be constructed for many different applications wherein personnel could don one or more commonly configured garments having an evacuation harness and have access to many of the above-mentioned advantages. Further additions or alterations may be made to the garments having an evacuation harness or to methods of using such devices, and may be made without departing from the spirit and scope of the present disclosure. Numerous modifications may be made by those skilled in the art without departing from the spirit and scope of the claimed subject matter, including but not limited to combinations of features that are individually disclosed or claimed herein. For these reasons, the scope of this disclosure is not limited to the above examples but is as set forth in the appended claims.

What is claimed is:

1. A garment having an evacuation harness comprising:

an outer wear unit including at least a torso portion; and an evacuation harness comprising:

a torso strap system connected to the outer wear unit;

the torso strap system including at least two upper connectors and at least one retaining strap, wherein when the garment is worn by a user the upper connectors are proximate an upper rear portion of the outer wear unit and the at least one retaining strap extends downward from the torso strap system along a portion of a leg of the user and includes a strap portion that encircles a leg of the user;

a drag strap coupling connected to the torso strap system and extending rearward relative to the outer wear unit; and a drag strap having a length and being connected at a first end to the torso strap system at a position above the drag strap coupling, the drag strap being selectively extendible rearward relative to the outer wear unit and having an additional connector positioned at an intermediate location along the length of the drag strap.

2. The garment having an evacuation harness of claim 1, wherein the drag strap that is selectively extendible rearward relative to the outer wear unit includes a second end that is connectable to a drag strap coupling of a like garment having an evacuation harness.

3. The garment having an evacuation harness of claim 1, wherein the drag strap is stowable within the outer wear unit and extendible through an aperture in the outer wear unit.

4. The garment having an evacuation harness of claim 1, wherein the drag strap further comprises a head support portion positioned between the intermediate location and the rear of the outer wear unit.

5. The garment having an evacuation harness of claim 1, further comprising a head restraint configured to be connected to the drag strap.

6. The garment having an evacuation harness of claim 1, wherein the at least one retaining strap further comprises a pair of straps that extend downward from the torso strap system at the rear of the garment.

7. The garment having an evacuation harness of claim 1, wherein the at least one retaining strap further comprises a releasable buckle.

8. The garment having an evacuation harness of claim 1, wherein the at least one retaining strap has a portion that is adjustable in length.

9. A rescue garment system comprising:

a first garment further comprising an upper body outer wear unit including at least a torso portion and an evacuation harness, wherein the evacuation harness further comprises a torso strap system connected to the outer wear unit, a drag strap coupling connected to the torso strap system and extending rearward relative to the outer wear unit, a drag strap connected to the torso strap system at a position above the drag strap coupling and being selectively extendible rearward from the outer wear unit, and a head restraint configured to be connected to the drag strap when said drag strap is extended from the first garment for use; and a second garment further comprising an outer wear pant including a leg strap system having at least one leg strap extending down at least a portion of a rear thigh region of the outer wear pant, wherein the at least one leg strap is connected to the outer wear pant and further comprises at least one connector.

10. The rescue garment system of claim 9, wherein the leg strap system further comprises a thigh encircling strap.

11. The rescue garment system of claim 9, wherein the at least one leg strap is directly connected to the rear of the outer wear pant.

12. The rescue garment system of claim 9, wherein the at least one leg strap of the second garment is configured to be connected to at least one auxiliary strap that is selectively extendable from the first garment of the evacuation harness system.

13. The rescue garment system of claim 9, further comprising a tow tarp configured to be connected to the first garment and to extend in a direction opposite a direction of the drag strap when said drag strap is extended from the first garment for use.

14. A method of connecting an individual to at least first and second rescuers with the individual and rescuers wearing similar outer wear units and similar outer wear pants, wherein each outer wear unit is part of a garment having an evacuation harness and each outer wear pant includes a leg strap system, with the evacuation harness further comprising a torso strap system connected to the outer wear unit, a drag strap coupling connected to the torso strap system and extending rearward relative to the outer wear unit, a drag strap connected to the torso strap system and being selectively extendible rearward relative to the outer wear unit, two or more auxiliary straps connected to the torso strap system and being selectively extendible from sides of the outer wear unit, and the leg strap system further comprising leg straps positioned proximate respective rear portions of thighs of the individual and rescuers, the method comprising the steps of:

extending from the garment of the individual the drag strap in a direction opposite to a direction that the individual is facing;

connecting the drag strap on the garment of the individual to the drag strap coupling on the garment of the first rescuer with the first rescuer being positioned in the direction opposite to the direction the individual is facing and having the drag strap coupling on the garment of the first rescuer extending in a direction rearward relative to the first rescuer, wherein the individual faces substantially opposite to a direction of forward travel of the first rescuer; and connecting at least one leg strap on the garment of the individual to one of the auxiliary straps on the garment of the second rescuer with the second rescuer being positioned rearward of the first rescuer and proximate a leg of the individual and having the auxiliary strap on the garment of the second rescuer extending in a direction toward the leg of the individual and being connected to the leg strap on the outer pant associated with the leg of the individual, wherein the individual faces toward the second rescuer and is lifted by the first and second rescuers to a position at least partially above a ground surface.

15. The method of connecting an individual to at least first and second rescuers of claim 14, further comprising the step of:

extending the drag strap from a stowed position through an aperture in the outer wear unit of the garment of the individual before connecting the drag strap to the drag strap coupling on the garment of the first rescuer.

16. The method of connecting an individual to at least first and second rescuers of claim 14, further comprising the step of:

connecting at least two of the auxiliary straps on the garment of the second rescuer to at least two leg straps on the garment of the individual.

17. The method of connecting an individual to at least first and second rescuers of claim 14, wherein the step of connecting the drag strap on the garment of the individual to the drag strap coupling on the garment of the first rescuer further includes the steps of:

extending the drag strap from the rear of the garment of the individual;

locating a connector at a position intermediate the length of said extended drag strap; and connecting the connector at the intermediate position to the drag strap coupling of the first rescuer.

18. The method of connecting an individual to at least first and second rescuers of claim 14, wherein the step of connecting the drag strap on the garment of the individual to the drag strap coupling on the garment of the first rescuer further includes the step of:

extending the drag strap from the rear of the garment of the individual;

locating a head support on said extended drag strap beneath a head of the individual; and connecting said drag strap to the drag strap coupling of the first rescuer.

19. A garment having an evacuation harness comprising:

an outer wear unit including at least a torso portion; and an evacuation harness comprising:

a torso strap system connected to the outer wear unit;

the torso strap system including at least two upper connectors, wherein when the garment is worn by a user the upper connectors are proximate an upper back or shoulder portion of the outer wear unit; and at least two auxiliary straps connected to the torso strap system and being laterally spaced apart, wherein each of the at least two auxiliary straps is stowable within a side pouch releasably covered by a flap and is selectively extendible from the outer wear unit.

20. The garment having an evacuation harness of claim 19, wherein the at least two auxiliary straps are extendible from the outer wear unit and connectable to the at least two upper connectors on the garment or to respective upper connectors on a similar garment.

21. The garment having an evacuation harness of claim 19, wherein each of the at least two auxiliary straps further comprises a releasable buckle for selective detachment of a length of the auxiliary strap from the torso strap system.

22. The garment having an evacuation harness of claim 19, wherein each of the at least two auxiliary straps further comprises at least one connector along the length of the auxiliary strap and a further connector at a distal end of the auxiliary strap.

23. A rescue garment system comprising:

at least two garments that are similar, each of the garments further comprising:

an outer wear unit including at least a torso portion; and an evacuation harness comprising:

a torso strap system connected to the outer wear unit;

the torso strap system including at least two upper connectors, wherein when the garment is worn by a user the upper connectors are proximate an upper back or shoulder portion of the outer wear unit; and at least two auxiliary straps connected to the torso strap system and being laterally spaced apart, wherein each of the at least two auxiliary straps is stowable within and selectively extendible from the outer wear unit through an aperture that is releasably covered by a flap.

24. The rescue garment system of claim 23, wherein each of the at least two auxiliary straps further comprises a releasable buckle for selective detachment of a length of the auxiliary strap from the torso strap system.

25. The rescue garment system of claim 23, further comprising:

at least two similar outer wear pant garments, each of the outer wear pant garments comprising:

an outer wear pant; and a leg strap system having at least one leg strap extending along at least a portion of a thigh region of the outer wear pant.

26. The rescue garment system of claim 25, wherein the at least one leg strap further comprises at least one connector.

* * * * *